US010077556B2

(12) United States Patent
Saleh

(10) Patent No.: US 10,077,556 B2
(45) **Date of Patent: *Sep. 18, 2018**

(54) RESIDENTIAL OR COMMERCIAL INTEGRATED SEE-THROUGH EAVES AND DOWNSPOUT GUTTER SYSTEM

(71) Applicants: 2298679 ONTARIO INC., Vaughn (CA); Nabil Saleh, Toronto (CA)

(72) Inventor: Nabil Saleh, Toronto (CA)

(73) Assignees: Nabil Saleh (CA); 298679 Ontario Inc. (CA)

( * ) Notice: Subject to any disclaimer, the term of this patent is extended or adjusted under 35 U.S.C. 154(b) by 0 days.

This patent is subject to a terminal disclaimer.

(21) Appl. No.: 15/675,062

(22) Filed: Aug. 11, 2017

(65) Prior Publication Data

US 2018/0112408 A1 Apr. 26, 2018

Related U.S. Application Data

(63) Continuation-in-part of application No. 15/333,978, filed on Oct. 25, 2016, now Pat. No. 9,777,482.

(51) Int. Cl.
*E04D 13/064* (2006.01)
*E04D 13/076* (2006.01)
(Continued)

(52) U.S. Cl.
CPC ..... *E04D 13/064* (2013.01); *E04D 13/076* (2013.01); *E04D 13/0725* (2013.01);
(Continued)

(58) Field of Classification Search
CPC ..... E04D 13/0645; E04D 13/064; E04D 13/0722; E04D 13/08; E04D 13/0833; E04D 13/084
See application file for complete search history.

(56) References Cited

U.S. PATENT DOCUMENTS 3,465,885 A * 9/1969 Trump ..... E04D 13/08 210/447
4,169,570 A * 10/1979 Morin ..... E04D 13/0725 248/48.2
(Continued)

FOREIGN PATENT DOCUMENTS

DE 2941202 A1 * 4/1981 ..... A01G 9/1476
FR 2913437 A1 * 9/2008 ..... E04D 13/08
(Continued)

*Primary Examiner* — Adriana Figueroa

(57) ABSTRACT

The present invention is a gutter system comprising at least a gutter section and one or more downspout sections. It may further incorporate one or more elbow sections. Each of the gutter, downspout and elbow sections may incorporate at least one see-through section. Such see-through sections allow for the monitoring of the rainwater flow and debris in the gutter system. This monitoring facilitates detection of the exact spot of where debris collects in the gutter system, so that blockages in the gutter system can be predicted and prevented, debris build-up in the gutter system can be cleaned, and the gutter system can be repaired. Rainwater runoff can flow through the gutter system, and unnecessary cleaning of the gutter system, and the cost thereof, can be avoided. The elbow sections may incorporate an access port for access to the interior of the elbow, to permit the removal of debris therefrom.

25 Claims, 22 Drawing Sheets

(51) Int. Cl.
*E04D 13/08* (2006.01)
*E04D 13/072* (2006.01)

(52) U.S. Cl.
CPC ..... *E04D 13/08* (2013.01); *E04D 13/0645* (2013.01); *E04D 13/0722* (2013.01); *E04D 2013/0833* (2013.01); *E04D 2013/0866* (2013.01)

(56) References Cited

U.S. PATENT DOCUMENTS

| | | | | | |
|---|---|---|---|---|---|
| 5,452,546 | A * | 9/1995 | Goddard | E04D 13/08 | 210/170.03 |
| 5,882,508 | A * | 3/1999 | St-Jacques | E03F 1/002 | 210/170.01 |
| 7,493,728 | B2 * | 2/2009 | Dussault | E03B 33/03 | 137/357 |
| 8,069,617 | B2 * | 12/2011 | Wootton | E04D 13/076 | 210/474 |
| 2003/0051414 | A1 * | 3/2003 | Bessette | E04D 13/08 | 52/16 |
| 2004/0040219 | A1 * | 3/2004 | Bacik | E04D 13/064 | 52/11 |
| 2008/0229673 | A1 * | 9/2008 | LaMorte | E04D 13/08 | 52/12 |

FOREIGN PATENT DOCUMENTS

| | | | | |
|---|---|---|---|---|
| GB | 2358886 | A * | 8/2001 | B01D 29/03 |
| JP | 05272202 | A * | 10/1993 | |

* cited by examiner

RESIDENTIAL OR COMMERCIAL INTEGRATED SEE-THROUGH EAVES AND DOWNSPOUT GUTTER SYSTEM

This application claims the benefit of U.S. Non-Provisional patent application Ser. No. 15/333,978 filed Oct. 25, 2016 and is a continuation-in-part of U.S. Non-Provisional patent application Ser. No. 15/333,978.

FIELD OF THE INVENTION

The present invention relates in general to gutter systems and, in particular, to a gutter system incorporating see-through sections for monitoring gutters and downspouts.

BACKGROUND OF THE INVENTION

Roofs are usually equipped with a gutter system. These systems typically each comprise a horizontal gutter trough open at its upper end, that is positioned virtually parallel to the edges of the roof of a building. The gutter collects the rain water from the roof and redirects it into a vertical downspout that directs the collected rainwater into a desired channel or drainage area away from the building.

One of the main issues with the presently available gutter systems is that debris, such as leaves, roofing material, sticks, animal dirt, and other objects collect within the prior art gutter systems. Such debris collected in the gutter system may block the flow of the water through the gutter system. Blockage tends to occur within the gutters, around the spikes or hangers, in the bends or elbows incorporated in the gutter systems (e.g., in the downspout system), in the downspout system and in other areas of the system.

A blockage of debris collected within the gutter system will cause a backup of water to overflow instead of running down the downspout. The excess water will then pour over the edges of the horizontal gutters (i.e., eaves or eavestroughs). This will cause the water to run down the sides of the building (e.g., a house or other building) damaging the sidings and catching the owner of the building completely by surprise as he/she was not aware of the problem building up in the first place. Such an outcome can be easily prevented by the present invention. (For ease of reference, all references to a building that is a house or a home herein also refer to any other type of building.)

This backup occurring in prior art systems causes a number of serious problems. For example, water may leak into the home from the sides of the house or from the frame of the windows (usually where the caulking is applied around the casing of the window), which can cause internal molding and other damages which leads to thousands of dollars in repairs. The overflow of water may also damage the covering materials of the home such as bricks, stucco or siding.

The blockage in the gutter system may also cause serious damage to the foundation of the building because the overflow of water from the walls may trickle into the ground surrounding the house and cause cracks in the foundation of the home. Therefore, gutters must be periodically cleaned to prevent serious damage to the home. The conventional method of eavestrough and downspout cleaning/repairs today has create significant costs for owners of buildings. The prior art is further prone to causing building owners to incur unnecessary cost due to being scammed into paying for a cleaning that was not done or paying for an eavestrough cleaning/repair that was not needed (examples are explained below).

The problem with the prior art eavestroughs, downspouts and elbows is that homeowners have zero knowledge of the physical/internal state of their gutters, downspouts or elbows. This leaves building owners vulnerable to many detrimental outcomes.

A homeowner may ask for their eaves or downspouts to be cleaned and call on a professional to take on that task (usually it is done 1-2 times a year at an average cost of CDN$150-200 dollars for each cleaning). Generally how this industry is run is that a professional will show up to the house set-up the ladder and get onto the roof. The professional will then proceed to "clean" the gutters (a complete gutter cleaning should take about 2.5-3 hrs including the downspouts). Once finished, the professional will invoice the customer for the service. The common problem that homeowners face in this situation is the inability to tell if the job was completed. Building owners are forced to reply on the word of the professional cleaner on-site. The inventor (a former gutter and downspout cleaner of 5 years) estimates that 9 times out of 10 the cleaner on-site either did a very poor job. For example, by collecting only a small fraction of debris from the eavestrough and showing it to the customer as evidence of a complete job while the job has not been fully completed. Or, as another example, by not doing the job at all.

The customer can be charged the full amount for a complete gutter cleaning without the customer checking for results. Due to the level of heights involved with gutter cleaning/repairing the homeowner is forced to take the cleaner/technicians word that the cleaning is fully completed. This leaves homeowners and their houses very vulnerable, and prone to damages. Un-cleaned gutters, downspouts and elbows can cause huge problems for homeowners down the line. For example, un-cleaned gutters means there is still debris left in the gutters. The amount of weight a gutter can sustain is limited before the hangers dislodge from the home and start to hang off. To repair damaged gutters would cost the homeowner thousands of dollars in repairs, all because debris was not removed during the original cleaning and eventually over time more debris accumulated thus causing damages.

Another issue with the conventional gutter and downspout system is that if a homeowner notices an overflow of water their first intention is to get the problem solved. So the homeowner calls on a professional to service them. The professional comes to the home, gets on the roof and offers a quote. Without the homeowner having knowledge of what's going on in the gutter, downspout or elbows the homeowner is in yet another vulnerable position. The building owner wants the problem fixed immediately and is willing to take the word of a professional. This is where the professional takes full advantage of the homeowner, charging top dollar for an overflow issue that could be for something as small as a bird nest being stuck in the gutter, downspout or elbow. Had the homeowner been aware of the issue at hand and been able to see how their eaves, downspouts or elbows look (i.e., the level of debris therein), this would have helped the homeowner to avoid a pricey fix and to obtain a more ACCURATE quote. Moreover, if handy enough, the homeowner could have easily resolved the issue themselves and avoided costly repairs (e.g., estimated CDN$400-800 dollar repairs).

Traditional prior art gutters, downspouts and elbows constrict the homeowner from knowing the condition that their gutters, downspouts or elbows are in. In some cases the homeowner will pay to have the gutters or downspouts cleaned once or twice a year either because they want to protect the investment in their home, because they were convinced by an eavestrough company to get the job done, or any other reason. Often times an eavestrough may be completely empty and, with no knowledge of how their eaves, downspouts or elbows look (i.e., the level of debris therein), the homeowner will spend a few hundred dollars to get the cleaning done when their eaves, downspout or elbows may not need it in the first place.

These, along with many other, problems are what homeowners face with the conventional gutter and downspout system. The conventional downspout system comprises of a series of elbows and adaptors which help direct and guide the flow of water and minor debris from the eavestrough to either the sewage line or lawn. When the water or debris passes through the conventional downspout system the elbow adaptors of the downspouts are highly prone to debris clogging as that is where the bend occurs in the downspout system. The bend is susceptible to this issue because of the ability for the debris to sit in the bend (i.e., the corner) of the elbow thus causing the elbow to become clogged. Traditional methods of unclogging an elbow would be to unassemble the downspout system which would cost a homeowner time (a professional takes about 2 hours and a homeowner takes upwards of 3-4 hours), money and a ton of headaches. The inventor's approach to this issue in the present invention resolves all headaches and saves the customer time and money. Not to mention that if the customer chooses to hire a professional to take on the problem the professional will have a much smoother job unclogging the elbows of the present invention than experienced with prior art elbows, and this in turn could potentially offer a cheaper quote to the customer to clean an elbow of the present invention thus saving the customer money.

Prior art has attempted to solve the problems in gutter systems by using debris collection devices. Such debris collection devices are generally located at the bottom of the prior art downspout, the spot least prone to getting clogged. The prior art further incorporates filters in gutter cleaning systems. Also, in some prior art, filters are used to prevent the blockage of the gutter system by capturing the debris flowing through the gutter system. Notably the prior art method of placing a filter at the top of the downspout has proved to do more harm than good and is a very simple way for clogging and backups to occur. The prior art discloses a wide variety of gutter systems of various structures and configurations intended to direct rainwater away from a roof of a house or other building structure, but the prior art systems have not helped solve the problems stated above. Most conventional gutter systems still have an open top, which can become clogged by leaves or other debris. Gutter systems with covers, such as screens intended to reduce clogging, are included in the prior art but these designs are faulty, can clog over time, and have not yet improved the gutter and downspout industry.

SUMMARY OF THE INVENTION

In one aspect, the present disclosure relates to a residential/commercial gutter system that allows for monitoring of the flow of the rainwater, and buildup of debris in the gutter, downspouts and/or elbows of the system. This gutter system can provide continuous monitoring of the gutter, downspouts and/or elbows. Such monitoring can allow for the detection of the exact spot where debris is collected therein. The monitoring can further allow for predicting blockages in the gutter, downspouts and/or elbows. The monitoring can also keep a building owner aware of the condition their eaves, downspouts or elbows and allow for timely cleaning thereof.

The present gutter, downspout and elbows of the gutter system have a plurality of strategically positioned transparent and/or translucent strips to allow for visual inspection of the flow inside the system. The eavestrough and downspout may be designed from a completely transparent or translucent material, or from a mixture of solid and transparent and/or translucent materials. For example, in an embodiment of the present invention there are transparent or translucent strips, or a mixture of translucent and transparent strips, longitudinally provided on the sides of the downspout as well as on the upper lip and bottom of the gutter. This provides a gutter system that avoids the unnecessary cleaning of the eavestrough and downspout and removal of debris from the gutters, and thereby eliminates the cost for cleaning incurred by the homeowner while keeping the view of the house aesthetically pleasing. The present invention serves the purpose of informing homeowners as to when a cleaning is due (e.g., once debris has reached the upper lip of the gutter, or reached some other level in the gutter, downspout or elbows, the homeowner recognizes that the gutter system or a section thereof is due for a cleaning, thus steering them away from faulty cleans, unnecessary cleans, and ensuring their gutters are in an optimal state). The transparent or translucent strips allow homeowners to have a clear view of their gutter, downspout and/or elbows in the gutter system, keeping them aware about the system and protecting them from the vulnerable positions discussed in the background of the invention section herein.

A gutter system usually comprises a horizontal gutter and a vertical downspout. Elbows are attached to the gutter and/or downspouts. The gutter system can be configured proximate to a structure, such as a residential house or other building, with an extended surface located above the gutter system, such as a roof. The gutter system can extend longitudinally, along and below the roof to allow rainwater or debris to flow from the roof into the gutter, and eventually down the downspout (and through any elbows incorporated in the system). The gutter system can be installed with a slight downward slope, to allow it to receive rainwater from the roof and direct rainwater toward the downspout. The debris collected in the gutter system can be monitored through the transparent or translucent sections of the gutter system. The blockage area can be discovered and cleaned by the homeowner or by a specialist to prevent destruction of the whole of the system.

The gutter system of the present invention will be reinforced and held up by elongated brackets or hangers, which help resolve common problems affecting prior art eavestrough systems that compromise thin brackets that only hold up sections of the gutter consistent with spacing intervals where the brackets are placed, for example such as spacing intervals of one and a half feet of the gutter. The elongated brackets or hangers of the present invention may be installed at similar spacing intervals to the prior art (or at different spacing intervals), but have the feature of an elongated front hook that serves to hold up and reinforce more of the gutter (e.g. larger sections of the gutter) than the prior art is capable of holding up. The present invention thereby eliminates any sagging or dislodging of the gutter caused by the buildup of debris or rainwater within the gutter.

The gutter system of the present invention provides elbows in connection points of the downspout or as attached to the gutter. The elbows have an access point, that is an access port, to allow access to the interior of the elbow.

Elbows of a downspout are the most prone to clogging, and the access port allows for the elbows to can be easily cleaned by the homeowners or professionals. The access point has a cap, that is an access port closure, that can be fastened on the access point, by a fastening means, or can be attached to the access port by friction or some other means, and can be easily removed for cleaning purposes (e.g., a simple twist-on and twist-off method, like opening a bottle cap, or by some other attachment method or configuration).

The gutter system of the present invention further comprises easy to assemble features. For example, one side that is an end of a downspout section (i.e., downspout trough) may have a female adapter while the other side that is an end of the downspout section may have a male adapter. The adapters configured into the ends of the downspout sections allow the downspout sections to be easily attached to each other. For example, an end of a downspout section may be screwed together with the end of another downspout section. AS another example, a downspout section to incorporate two male adapting ends may be connected to a middle component, and said middle component may be fit between two downspout sections, a downspout section and elbow section, or a downspout section and the gutter. A skilled reader will recognize that other adpaters may be configured into downspout sections to allow for the connection of the downspout sections to another downspout section, to a middle component, to the gutter, or to an elbow section. The adapters configured into the ends of a downspout section facilitate an easy set-up/disassembly process for the downspout system (i.e., one or more downspout sections connected, and possibly incorporating one or more elbow sections, to extend from the gutter to the ground) of the gutter system.

A skilled reader will recognize that elbows of the present invention may also be configured to incorporate an adapter at one or more end of an elbow section, and that such adapters may be connectable to a downspout, or to a middle component, in a similar manner as is discussed herein in relation to configurations to connect downspouts to each other or to a middle component.

In another aspect, the present disclosure relates to an elbow section, comprising: four walls including an inner-bend wall positioned opposite an outer-bend wall and being connected to each of two side walls that are positioned opposite to each other; one or more see-through sections incorporated in at least one of the four walls extending from one end of the elbow to the opposite end; an access port incorporated in at least one of the plurality of elbows included in a gutter system, each access port comprising an opening incorporated in one of the walls of the downspout elbow; and a removable access port covering configured to fit over the access port to thereby close the access port. The closure may form a leak-proof seal and access to the interior of the elbow may be restricted thereby.

Furthermore, the present invention may incorporate: the one or more see-through sections of the elbow section being one of the following: a transparent strip, or a translucent strip; at least one end of the elbow is configured to attach to a downspout or a gutter trough; the one or more see-through sections in the elbow section being integrated with the elbow section.

In another aspect, the present disclosure relates to a gutter system for monitoring of debris in a gutter trough and a downspout trough, each of said gutter trough and downspout trough being positioned proximate to a building, said gutter system comprising: the gutter trough positioned near-horizontally in relation to the building such that sections of the gutter trough are positioned proximate to one of the one or more side-walls of the building, the gutter trough incorporating three walls including a gutter-base-wall that is connected on its front facing side to a gutter-front-wall and on its opposite a rear facing side to a gutter-rear-wall, said gutter-front-wall and said gutter-base-wall each incorporating a longitudinal see-through section positioned so as to extend from one end of the gutter trough to the opposite end of the gutter trough; one or more downspout troughs, each downspout trough incorporating four walls including a downspout-front-wall positioned opposite to a downspout-rear-wall and being connected to each of two downspout-side-walls that are positioned opposite to each other, the four walls forming an elongate trough, at least one of said downspout-side-walls incorporating a longitudinal see-through section extend from one end of the downspout to the opposite end of the downspout, and said downspout troughs each having the downspout-rear-wall positioned proximate to one of the side walls of the building and the downspout troughs each being attached to one of the side-walls of the building; and a plurality of downspout elbows, at least one of such plurality of downspout elbows being connectable to the gutter trough and to one or more of the downspout troughs.

The gutter system may be configured in a variety of manners, having various sections connected to other sections. For example, a gutter trough may be connected to an elbow and said elbow may be connected at its end that is distant from the gutter to one of said one or more downspout troughs. One or more downspout sections, elbows or other connection sections may be connected in any order and incorporated in the gutter system below the downspout trough. In this configuration of the gutter trough flow of rainwater and debris is navigated along at least a portion of the gutter trough through the downspout elbow connected to the gutter trough, to the downspout trough connected to the downspout elbow, through any additional sections of the gutter section (i.e., gutter through) between the downspout trough and the ground, towards a ground surface.

As another example, a gutter trough may be connected to a downspout troughs and the downspout trough may be connected at its end that is distant from the gutter to an elbow. One or more downspout sections, elbows or other connection sections may be connected in any order and incorporated in the gutter system below the downspout trough. In this configuration of the gutter trough flow of rainwater and debris is navigated along at least a portion of the gutter trough through the downspout connected to the gutter trough, to the elbow and through the elbow, through any additional sections of the gutter section between the elbow and the ground, towards a ground surface. A skilled reader will recognize that other configurations of the gutter system are also possible.

Furthermore, the gutter system incorporates: one or more see-through sections of the gutter trough being one of the following: a transparent strip, or a translucent strip; one or more see-through sections of the downspout being one of the following: a transparent strip, or a translucent strip; see-through sections in the gutter trough being integrated with the gutter trough; and the see-through sections in the downspout being integrated with the downspout.

In another aspect, the present disclosure relates to an elbow section, comprising four walls including an inner-bend wall positioned opposite an outer-bend wall and being connected to each of two side walls that are positioned opposite to each other, and further incorporating an enlarged midsection; an access port incorporated in at least one of the plurality of downspout elbows comprising an opening incorporated in one of the walls of the downspout elbow; and a removable access port covering configured to fit over the access port to thereby close the access port.

Furthermore, the elbow section incorporates: one or more see-through sections of the elbow section being one of the following: a transparent strip, or a translucent strip; at least one end of the elbow section being configured to attach to a downspout or a gutter trough; and one or more see-through sections being incorporated in at least one of the four walls extending from one end of the elbow to the opposite end, such see-through sections being integrated with the elbow section and being either transparent or translucent.

In another aspect, the present disclosure relates to a gutter section, comprising a gutter-base-wall that is connected on its front facing side to a gutter-front-wall and on its opposite a rear facing side to a gutter-rear-wall, said gutter-front-wall and said gutter-base-wall each incorporating a longitudinal see-through section positioned so as to extend from one end of the gutter trough to the opposite end of the gutter trough, said gutter section being connectable to an elbow section or a downspout section.

In another aspect, the present disclosure relates to a downspout section, comprising a downspout-front-wall positioned opposite to a downspout-rear-wall and being connected to each of two downspout-side-walls that are positioned opposite to each other, said downspout-front-wall, downspout-rear-wall and two downspout-side walls forming an elongate trough, and at least one of said downspout-side-walls incorporating a longitudinal see-through section extending from one end of the downspout to the opposite end of the downspout, said downspout section being attachable to an elbow section, another downspout section, or a gutter section.

One object of the present invention is to provide a building owner with a clear view of the eavestroughs, downspouts and/or elbows, such that the view allows for debris therein to be visible so as to alert the building owner to the potential for, and to prevent, any blockage of the gutter system.

It is another object of the present invention is to prevent unnecessary gutter cleaning and save a building owner from paying unnecessary expenses.

It is another object of the present invention is to monitor and control the gutter cleaning so as to avoid charges by the gutter cleaning companies for a cleaning that is not performed.

It is another object of the present invention to allow a building owner to pinpoint a debris build-up issue accurately in a gutter system. Identification of a blockage point, or a potential blockage point, in the gutter system has the benefit of preventing the destruction of the whole gutter system. This method also offers the benefit of receiving a more accurate quote from a professional gutter cleaner if the building owner decides to get the debris removed by a third party, which in turn can save the building owner money.

It is another object of the present invention to enable the building owners to obtain a clear view of the gutter system and any debris therein, while maintaining an aesthetically pleasing look to their building.

It is another object of the present invention to provide a gutter system with elbows with access points that facilitate easy cleaning of the elbows, as elbows are areas that are highly prone to clogging within the gutter system.

It is another object of the present invention to provide a gutter system for achieving early detection of a blockage in the gutter system before the system becomes completely backed-up.

It is another object of the present invention to provide added reinforcement to support gutters through use of elongated gutter brackets/hangers that avoid the common problem of sagging or dislodging of the gutter that occurs due to the accumulation of rainwater or debris within a gutter.

It is another object of the present invention to provide a gutter system that can allow a building owner to easily observe the water flow in a gutter system, to easily detect a point of blockage in the gutter system, and to prepare a cleaning or repair plan to remove the blockage.

These objects, as well as other objects and advantages will become more apparent in the description that is set forth herein below, particularly when read in conjunction with the accompanying drawings.

In this respect, before explaining at least one embodiment of the present invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

BRIEF DESCRIPTION OF THE DRAWINGS

The invention will be better understood and objects of the invention will become apparent when consideration is given to the following detailed description thereof. Embodiments herein will hereinafter be described in conjunction with the appended drawings provided to illustrate and not to limit the scope of the claims, wherein like designations denote like elements. Such description makes reference to the annexed drawings wherein:

Figure 1:
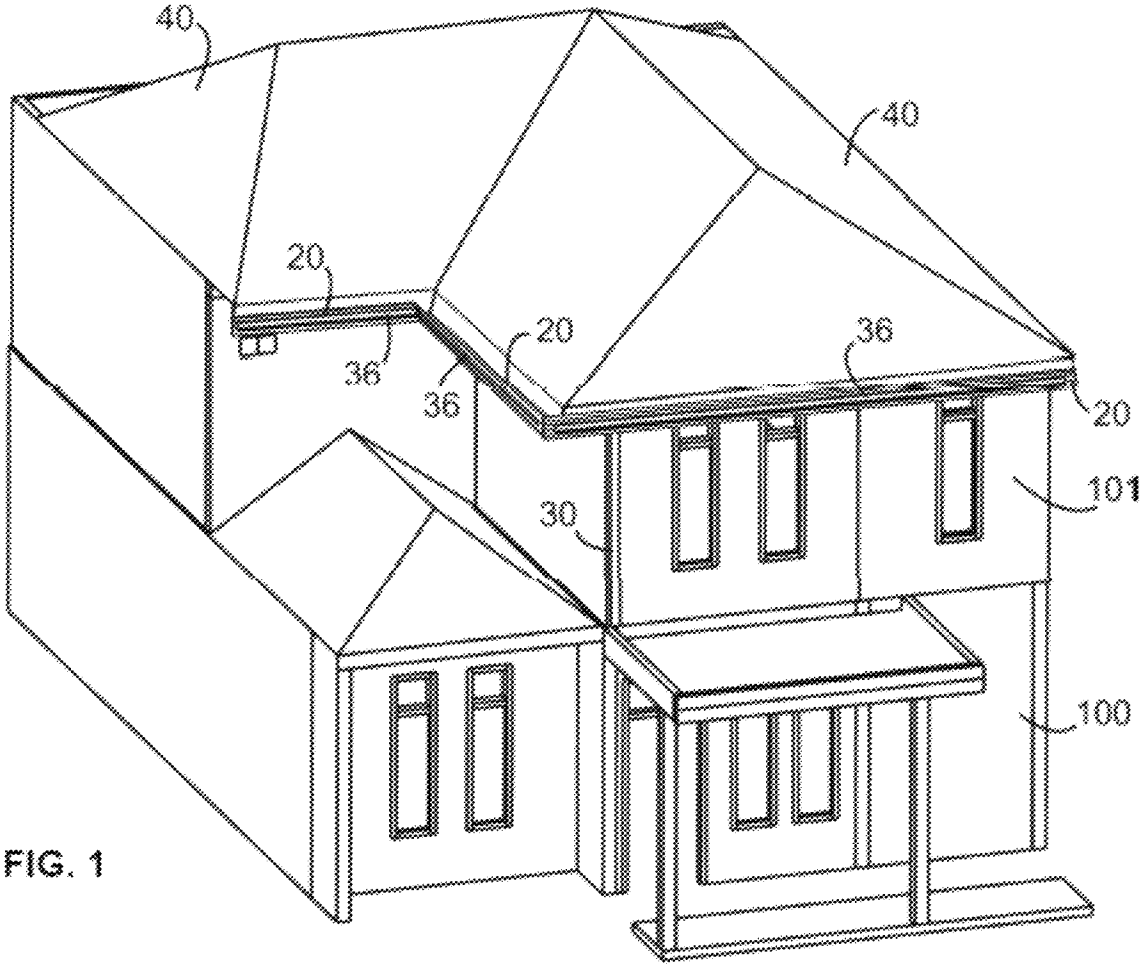
FIG. 1 shows a perspective view of a building with the gutter system attached thereto, in accordance with an embodiment of the present invention.
Figure 2A:
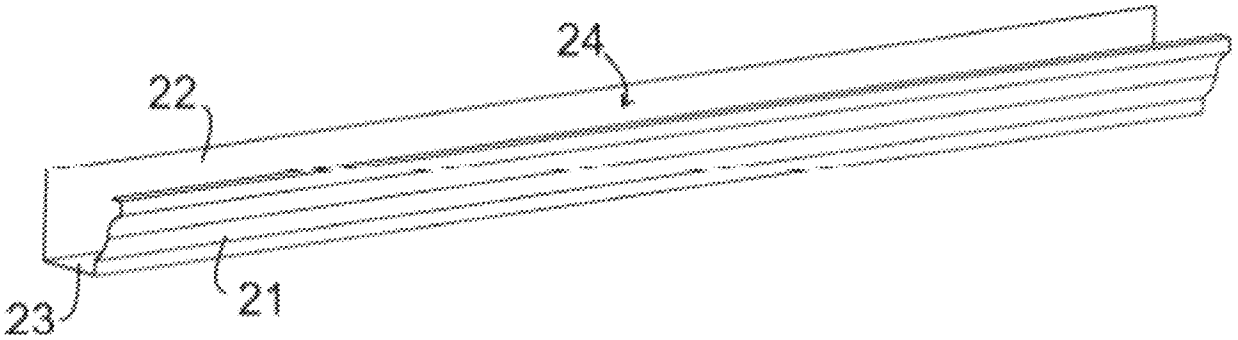
FIG. 2A shows a perspective view of a gutter showing the left side thereof, in accordance with an embodiment of the present invention.
Figure 2B:
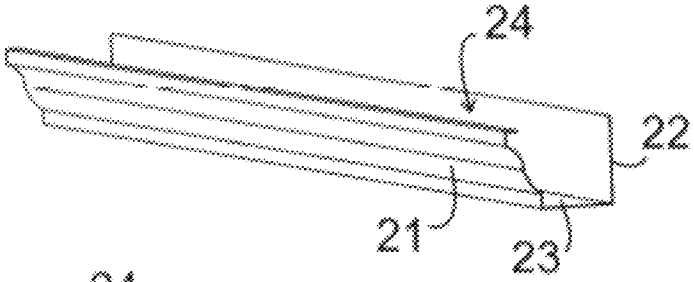
FIG. 2B shows a perspective view of a gutter showing the right side thereof, in accordance with an embodiment of the present invention.
Figure 2C:
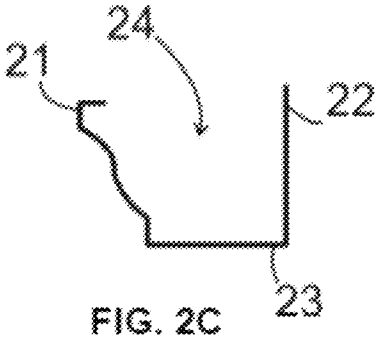
FIG. 2C shows a cross-sectional side view of a gutter, in accordance with an embodiment of the present invention.

In the drawings, embodiments of the invention are illustrated by way of example. It is to be expressly understood that the description and drawings are only for the purpose of illustration and as an aid to understanding, and are not intended as a definition of the limits of the invention.

The figures are not intended to be exhaustive or to limit the present invention to the precise form disclosed. It should be understood that the invention can be practiced with modification and alteration, and that the disclosed technology be limited only by the claims and equivalents thereof.

The technology disclosed herein, in accordance with one or more various embodiments of the present invention, is described in detail with reference to the figures described herein. The drawings are provided for purposes of illustration only and merely to depict typical or example embodiments of the disclosed technology. These drawings are provided to facilitate the reader's understanding of the disclosed technology and shall not be considered limiting of the breadth, scope, or applicability thereof. It should be noted that for clarity and ease of illustration these drawings are not necessarily made to scale.

DETAILED DESCRIPTION OF PREFERRED EMBODIMENTS

The present invention is a gutter system comprising at least a gutter section and one or more downspout sections. It may further incorporate one or more elbow sections. Each of the gutter, downspout and elbow sections may incorporate at least one see-through section. Such see-through sections allow for the monitoring of the rainwater flow and debris in the gutter system. This monitoring facilitates detection of the exact spot of where debris collects in the gutter system, so that blockages in the gutter system can be predicted and prevented, debris build-up in the gutter system can be cleaned, and the gutter system can be repaired. Rainwater runoff can flow through the gutter system, and unnecessary cleaning of the gutter system, and the cost thereof, can be avoided. The elbow sections may incorporate an access port for access to the interior of the elbow, to permit the removal of debris therefrom.

A see-through section in any of the gutter section, downspout sections or elbow sections of the gutter system may be transparent, translucent or a mixture of transparent and translucent. One or more see-through sections in any of the gutter section, downspout sections or elbow sections of the gutter system may be coloured. The one or more see-through sections in any the gutter section, downspout section or elbow section is integrated with the opaque material of such gutter section, downspout section or elbow section, and extends the full length of the gutter section, downspout section or elbow section.

An elbow section in the present invention may incorporate an enlarged midsection to facilitate better flow of water and debris through the elbow section, and to diminish the buildup of debris in the elbow section that can lead to clogging. An elbow section incorporating an enlarged midsection may be formed of an opaque material, a transparent or translucent material, or an opaque material having one or more see-through sections integrated therein.

FIG. 1 illustrates a perspective view of a building 100 with the gutter system of the present invention attached thereto. The present invention is a gutter system 10 comprising a horizontal gutter 20 and a vertical downspout 30. The horizontal gutter 20 may be formed in accordance with several profiles and sizes and may extend longitudinally along the lower sides of the roof 40, to allow rainwater to flow from the roof 40 into the gutter 20, whereby rainwater is directed toward downspout 30.

As shown in FIGS. 2A, 2B, 2C, 3A, 3B, 3C, 4A, 4B, and 4C the horizontal gutter 20 comprises a front wall 21, a rear wall 22, and a base 23 that form a channel 24 for receiving and channelling rainwater. The horizontal gutter 20 is configured to attach to and to extend longitudinally along a side wall or fascia of the building or house. The horizontal gutter 20 can be attached to the building 100 with hangers, brackets or other attachment means 60. The examples of the attachment means are shown in FIGS. 6A, 6B and 6C.

Figure 6A:
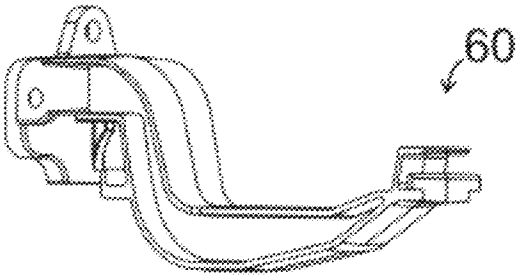
FIG. 6A shows a perspective view of an attachment means, in accordance with an embodiment of the present invention.
Figure 6B:
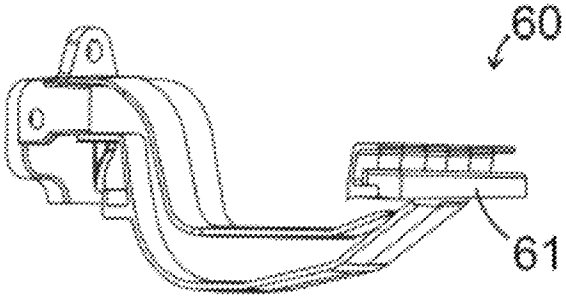
FIG. 6B shows a perspective view of an attachment means incorporating a wider grabbing means, in accordance with an embodiment of the present invention.
Figure 6C:
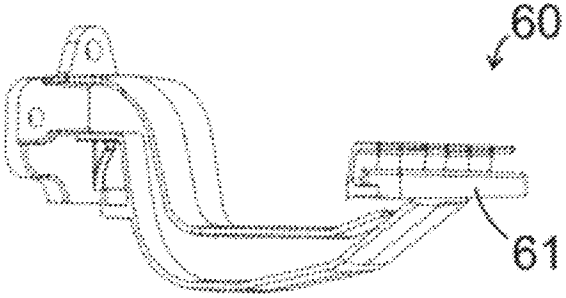
FIG. 6C shows a perspective view of an attachment means that is formed of a transparent material, in accordance with an embodiment of the present invention.

Again as shown in FIGS. 6A, 6B and 6C, the attachment means 60 has a grabbing means 61 which grabs the front wall of the gutter. In the present invention, the grabbing means 61 can be designed in such a way that it grabs more area in the front wall as needed for holding the gutter system securely on the building. As shown in FIG. 6C, the attachment means 60 can be completely opaque, transparent or translucent.

Figure 5C:
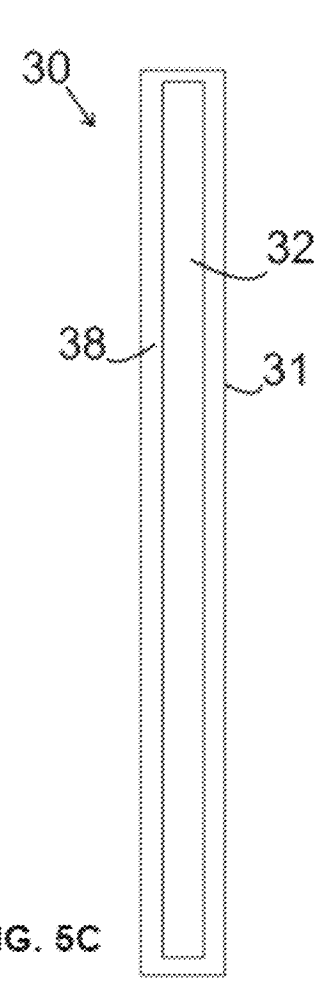
FIG. 5C shows a side view of a downspout incorporating a transparent strip in a side wall, in accordance with an embodiment of the present invention.
Figure 5B:
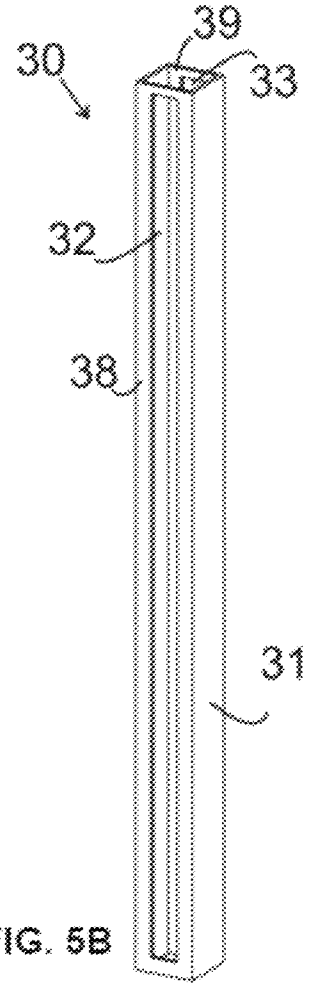
FIG. 5B shows a perspective view of a downspout incorporating transparent strips in each of two side walls, in accordance with an embodiment of the present invention.
Figure 5A:
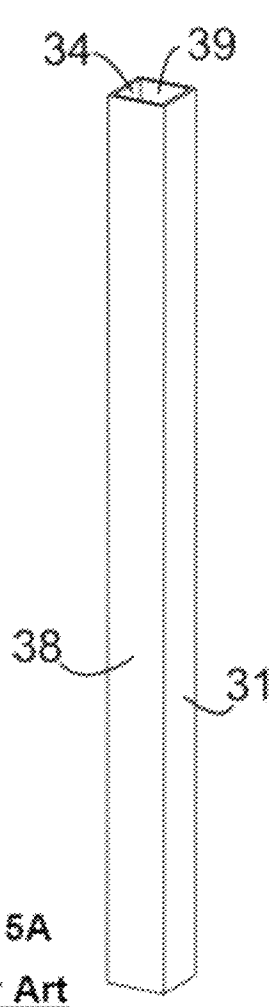
FIG. 5A Prior Art
FIG. 5A shows a perspective view of a prior art downspout.

As shown in FIG. 1, a downspout 30 is an enclosed channel that may be have a spherical, rectangular, or other shape formed by its walls. The enclosed channel functions as a tubular trough and may be positioned vertically on the side wall 101 of a building to direct water flow downward from the horizontal gutter 20. As shown in FIGS. 5A, 5B and 5C, a downspout comprises a front wall 31, a left wall 38, a right wall 39 and a rear wall 34, attached to and extending longitudinally along a side wall 101 or fascia of a building 100.

FIGS. 2A, 2B, 2C, 4A and 4B show a gutter section formed of a single type of material, that may be an opaque, transparent or translucent material. FIGS. 3A, 3B, 3C, and 4C show the gutter section 20 of the present invention that incorporate one or more see-through sections. The see-through section may be formed of a transparent or translucent material. In one embodiment, a transparent strip 36 is incorporated in the front wall 21 at an elevation about 2.5 inches from the base 23 and acts as an indicator for the homeowners monitoring the rainwater flow in the gutter system of a building. The transparent strip 36 is longitudinally provided on the front wall 21 of the gutter 20. A skilled reader will recognize that other sizes and placements of see-through strips incorporated in a gutter section are possible.

Figures 3A, 3B, 3C:
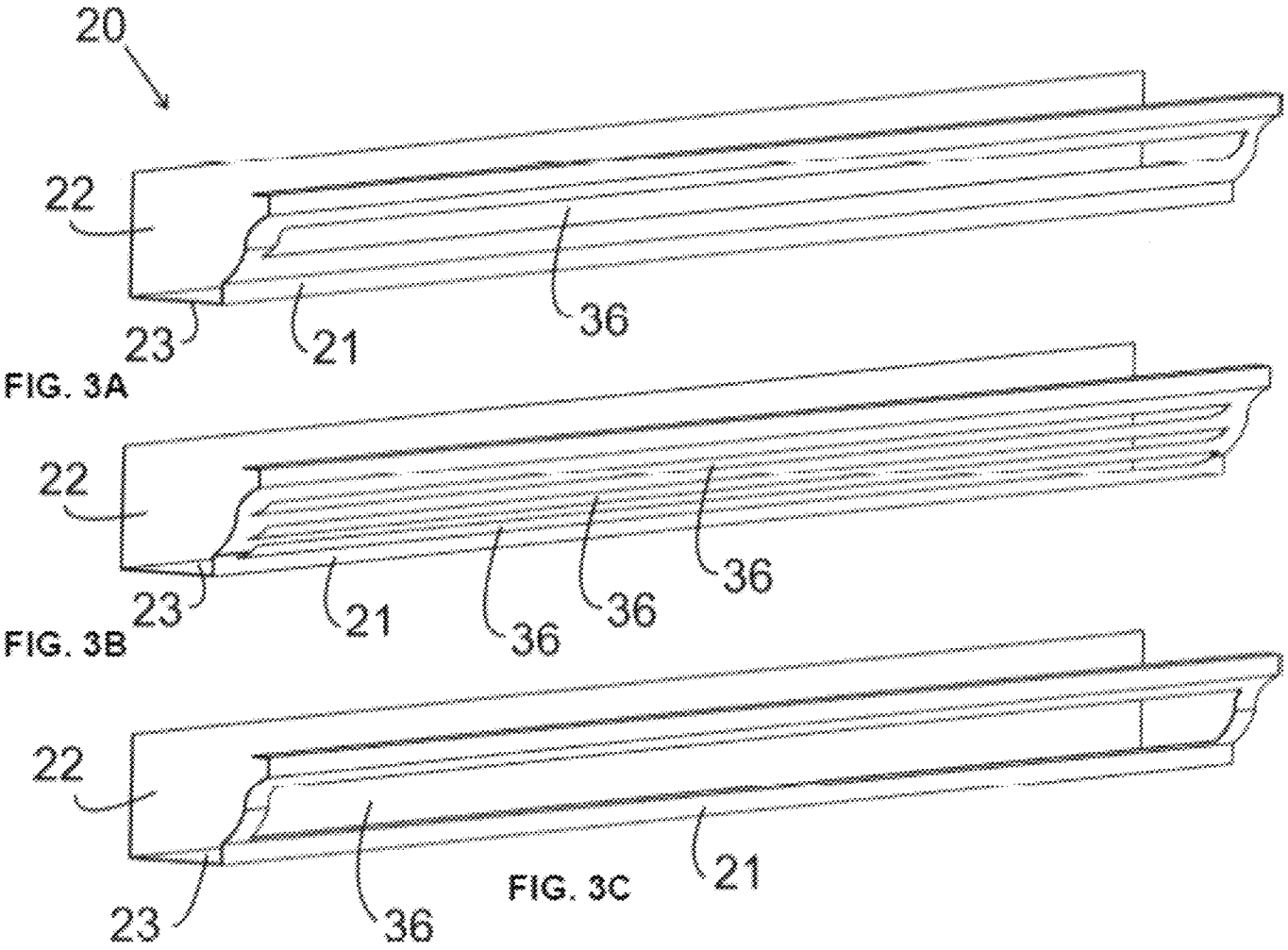
FIG. 3A shows a perspective view of a gutter incorporating a transparent strip, in accordance with an embodiment of the present invention.
FIG. 3B shows a perspective view of a gutter incorporating a plurality of transparent strips, in accordance with an embodiment of the present invention.
FIG. 3C shows a perspective view of a gutter incorporating a wide transparent strip, in accordance with an embodiment of the present invention.

As shown in FIG. 3B, the front wall 21 of the gutter 20 may have a plurality of longitudinal transparent strips 36. This arrangement for the transparent strips, helps homeowners understand the amount of debris inside the gutter 20.

For clarity, any reference to a "homeowner" herein is a reference to a homeowner or the owner of any other type of building (i.e., any residential or commercial building) and any reference to "building owner" may reference a homeowner. Moreover, any reference to a "house" or a "home" herein is a reference to a house, home or any other type of building (i.e., any residential or commercial building), and any reference to a "building" may include any house or home.

Figure 4A:
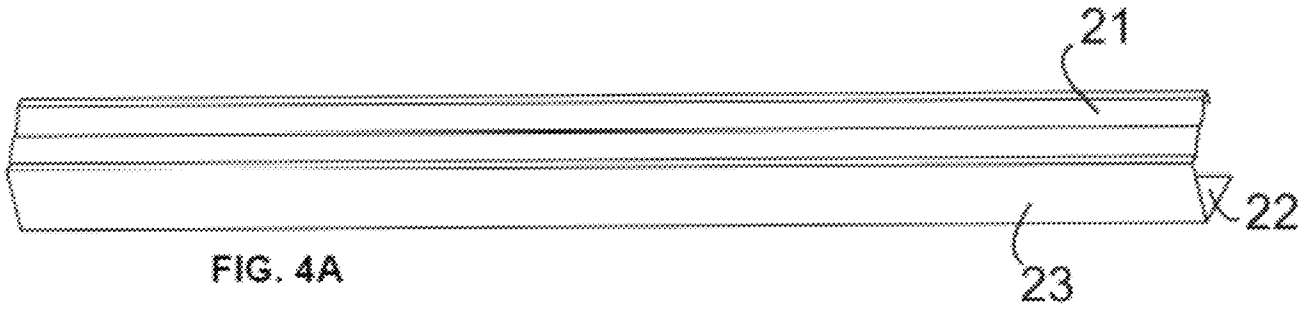
FIG. 4A shows a bottom view of a gutter, in accordance with an embodiment of the present invention.
Figure 4B:
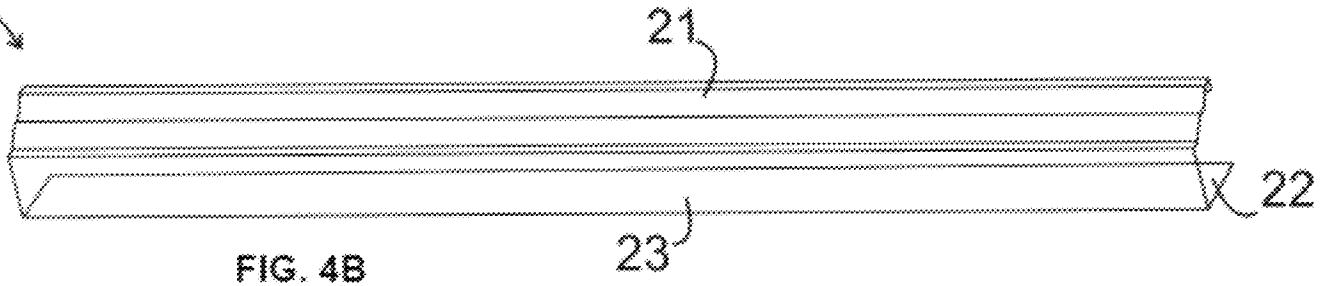
FIG. 4B shows a bottom view of a gutter incorporating a bottom section formed of a transparent material, in accordance with an embodiment of the present invention.
Figure 4C:
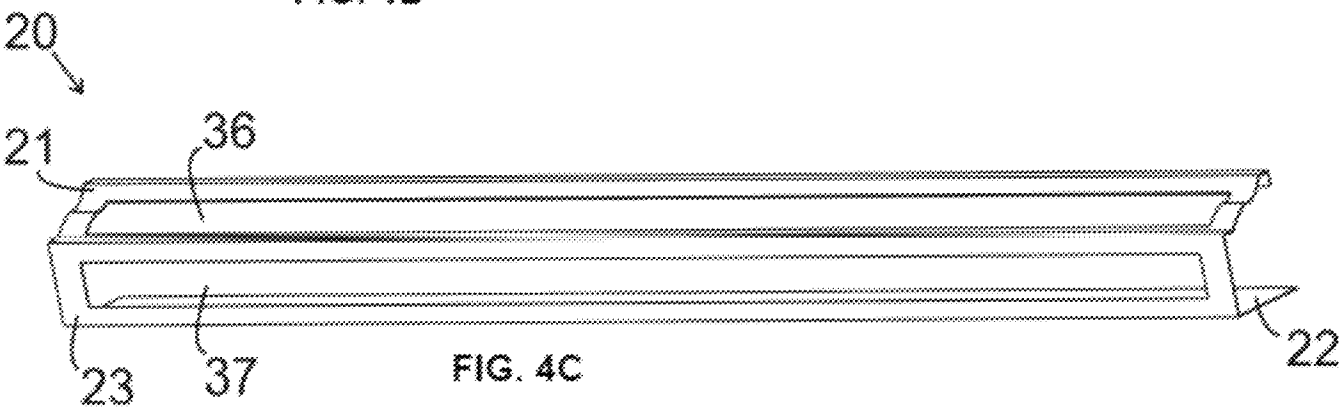
FIG. 4C shows a bottom view of a gutter incorporating a transparent strip in the front wall and the base wall, in accordance with an embodiment of the present invention.

As shown in FIG. 4A, the base 23 can be formed of an opaque material, or the whole structure of the gutter system can be formed of the opaque material similar to the conventional gutter system in the market. In one embodiment of the present invention, the base 23 can be constructed of a transparent or translucent material as shown in FIG. 4B. If the base of a gutter section is formed of a transparent or translucent material, or incorporates in any manner a see-through section, blockage or debris buildup in the gutter can be observed by the homeowners and alert them to take an action to clean the gutter. In one embodiment of the present invention as shown in FIG. 4C, the horizontal gutter 20 comprises a transparent strip 37 that is longitudinally attached to the base 23. In another embodiment of the present invention, the gutter can be completely constructed of a transparent or translucent material using a variety of methods, such as an extrusion and/or a moulding process.

FIG. 5A shows a conventional, prior art downspout. FIGS. 5B and 5C show embodiments of the downspout 30 of the present invention. The downspout 30 of the present invention has at least a transparent strip 32 longitudinally incorporated in the left side wall 38, or a transparent strip 33 incorporated in the right side wall 39. In this case transparent strips 32, 33 are attached/built in longitudinally to the side walls of the downspout 30, extending along the length of the downspout 30. This method will not damage the aesthetic appearance of the building with viewable debris.

In another embodiment of the present invention, the downspout is constructed completely of a transparent or translucent material using a variety of methods, such as an extrusion and/or a moulding process. In this case any blockage or debris build-up in the downspout can be observed by the homeowners and alert them to take an action to clean the downspout.

The gutter system of the present invention, including any downspout, gutter, or elbow of the gutter system, can be made of a variety of different materials, such as plastic, or metal, or aluminium. The gutter system of the present invention may comprise a transparent material which is sun resistant and capable of withstanding both hot and cold temperatures and thereby able to avoid warping, cracking, breakage or other damage.

Some embodiments of the gutters, downspouts and elbows of the present invention comprise structures that are either wholly transparent or translucent, or that incorporate one or more see-through sections, to facilitate visual inspection of the interior of such gutters, downspouts and elbows. Preferred materials to form the transparent, translucent structures or see-through sections therein are polycarbonates such as Lexan and polyacrylates such as Plexiglas. Such structures or the see-through sections therein can also be made of a glass material. Any glass composition, including specially formulated glass, may be used, such as laminates of glass. In the present invention, a combination of plastic and glass may also be used to form such structures or the see-through sections therein.

An embodiment of an elbow section of the present invention is shown in FIGS. 7A, 7B, 7C and 7D. The elbow 50 of the present invention is the most highly prone place for clogging by debris. The elbow 50 further has a front side 51, a rear side 52, and side walls 53, 54, and are bent at an angle of 45 degrees, or elbows can also come in bends of 90 degrees, 75 degrees, and 45 degrees, or any other angle. The elbow 50 provides an access point that is an access port 55 to access the elbow 50 interior that may be clogged and can be literally cleaned by the homeowner in a minutes of time. (Prior art methods would require the homeowner to disassemble the entire downspout system to access the clogged areas.) The access port 55 has a cap that is an access port closure 56 that can be fastened on the access port 55 by a fastening means. The cap can be removed so that the interior of the elbow can be accessed, such as for the purpose of cleaning the interior of the elbow to remove debris therefrom.

Figures 7A, 7B, 7C, 7D:
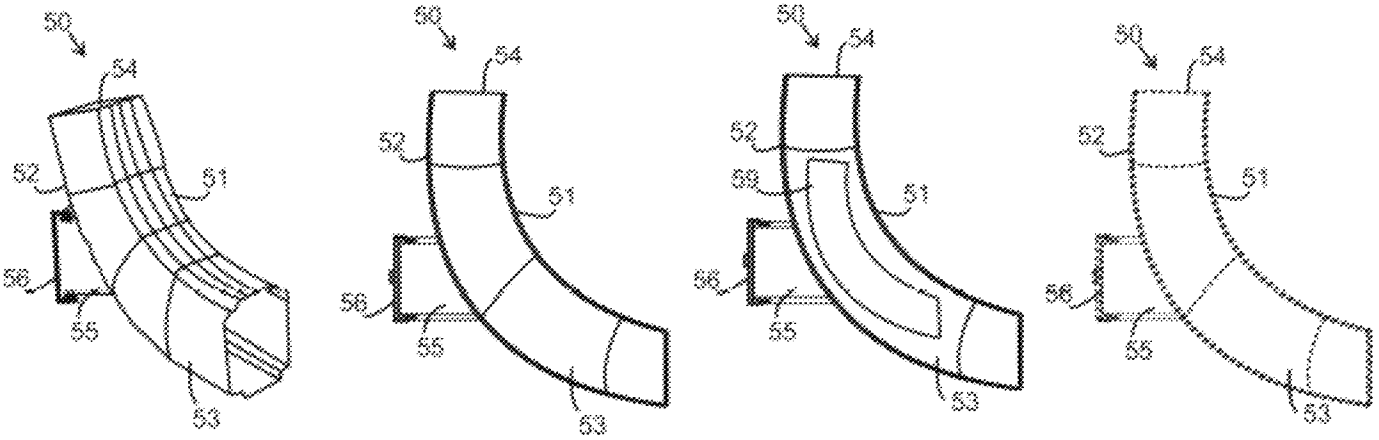
FIG. 7A shows a perspective view of an elbow section, in accordance with an embodiment of the present invention.
FIG. 7B shows a side view of an elbow section, in accordance with an embodiment of the present invention.
FIG. 7C shows a side view of an elbow section incorporating a transparent strip in a side wall, in accordance with an embodiment of the present invention.
FIG. 7D shows a side view of a elbow section formed of a transparent material, in accordance with an embodiment of the present invention.

As shown in FIG. 7C, the elbow 50 may incorporate one or more transparent strips 59 along one or more of the elbow walls. The transparent strip 59 facilitate viewing of at least a portion of the interior of the elbow, even when the cap is attached to the elbow, and by such viewing clogging or build-up of debris inside the elbow 50 can be viewed. In one embodiment of the present invention, the elbow 50 can be formed of a transparent or translucent material.

Figure 8:
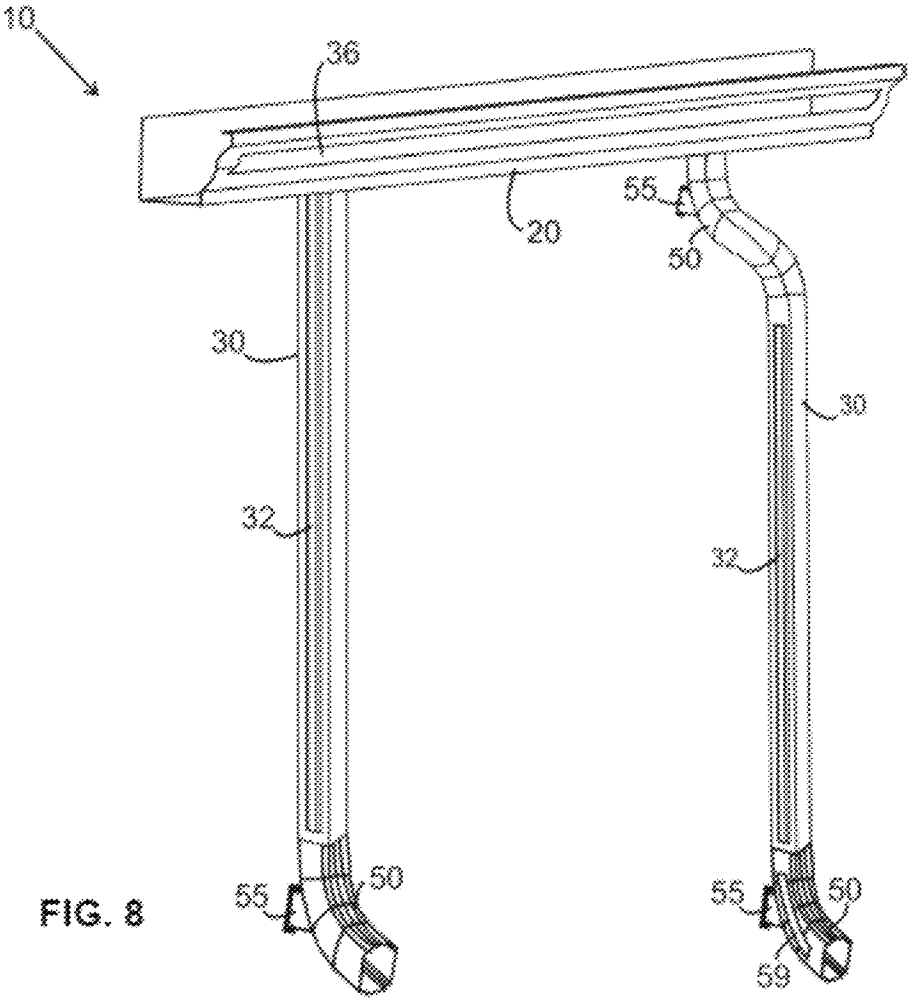
FIG. 8 shows a perspective view of the gutter system incorporating a plurality of downspouts attached to a gutter, in accordance with an embodiment of the present invention.

Cleaning the gutters and downspouts in a conventional prior art method can take up to several hours and can requires the use of special tools or can necessitate the services of an industry professional. In embodiments of the present invention, if the debris has clogged the gutter system 10, in the gutter 20, downspout 30 and/or elbow, as shown in FIG. 8, the homeowner has a view of where the problem lies through the one or more see-through sections incorporated in the gutter, downspout and/or the elbow, or any wholly transparent or translucent gutter, downspout and/or elbow in the gutter system. If the homeowner chooses to hire a professional to clean the gutter system the homeowner now has the confidence of knowing the job will be done to satisfaction and the homeowner will be charged the correct amount for the services rendered. The homeowner can see the extent of any debris build-up or clogging and therefore has a sense of the scope of the clean-up work that needs to be undertaken by the professional. The gutter system can be viewed through the see-through strips therein (that are transparent or translucent strips, or are wholly transparent or translucent gutters, downspouts or elbows), and can be cleaned without disassembling the whole gutter system. Moreover, if there is debris build-up or clogging in an elbow, the homeowner can view the debris or clogging area and access it through the access port of the elbow and clean the blocked area. It may even be possible to access debris build-up and clogs in any downspout or gutter directly connected to an elbow through the access port of the elbow.

The gutter system of the present invention may attach along the eaves of a building by any of several means, including straps, brackets, and hangers. The brackets can be adapted to be secured to the side wall of a building/house underneath the eaves of a roof and connected to fascia board of a home. A skilled reader will recognize other means of attaching bracket, straps and/or hangers to attach a gutter system to a building. A plurality of brackets and hangers can be spaced along the gutter to support the gutter system (for example, such as roughly every 2-3 feet, or some other spacing). The brackets of the present invention can comprise brackets formed of transparent, translucent or opaque materials, or brackets formed of different materials. The brackets of the present invention are elongated for additional support, this added reinforcement helps to avoid any dislodging/sagging of the gutters that occurs when a build-up of debris or rain water has accumulated.

The hangers/brackets of the gutters are elongated for added support to reinforce the support necessary to hold a gutter in a particular position in relation to a building, to increase the sustainability of the gutter in such a position when connected to the building and avoid any sagging or dislodging of the gutter that dislodges the gutter from the preferred position. The downspouts are connectable to elbows that may each incorporate an access port to ensure easy access to the most vulnerable parts of the gutter system that are prone to clogging, namely the elbow sections.

The gutter system of the present invention further comprises an easy to assemble feature. Such a feature may be configuration of the downspout sections to cause such sections to be easily connected to other downspout sections. For example, one end of a downspout section may have a female adapter while the other end has a male adapter. The female adapter end of one downspout section may be connected to the male adapter end of another downspout section. This allows the downspout sections to be easily screwed together to facilitate an easy set-up/disassembly process. In another configuration a middle component may be configured to incorporate ends that are each attachable to the same type of adapter, such as a male adapter. Such a middle component can be attached at one end to one downspout section and at the opposite end to another downspout section. As an example, in this manner a middle component can be used to form an attachment between two downspout section each having male adapting ends (or each having female adapting ends) facing each other, whereby the middle component connects the two ends of the two downspout sections (that would not otherwise be connectable). A skilled reader will recognize that downspout sections can be configured to incorporate other types of adapters.

Whenever the homeowners experience a backup in their gutter system, they can either simply clean it themselves, which saves them money, or call a professional. The gutter system of the present invention makes disassembly and cleaning of the blocked area or area having debris build-up easier even for the professionals, therefore, reducing cost to the homeowner. The gutter system of present invention may also make it easier for a homeowner to clean the gutter system of debris build-up or blockages themselves, thereby avoiding any payment to a professional.

Cleaning of a gutter system before debris build-up forms a significant blockage or clog can avoid any water seepage through the borders of each of the downspouts and further avoid dirty water running down the external part of the spout and potentially staining it. This makes it easier and simpler for the homeowners to take care of their downspouts and their gutter systems generally.

The gutter system of the present invention can be optionally used in conjunction with a leaf guard or a screen positioned in relation to a gutter, as is known in the art, to minimize the entry of debris into to the gutter.

FIGS. 9A, 9B, 9C, and 10 show embodiments of the gutter system of the present invention wherein one or more see-through sections 86 are incorporated in a gutter 80. The horizontal gutter 80 comprises a front wall 81, a rear wall 82, and a base 83 that form a channel for receiving and channelling rainwater. The horizontal gutter 80 is configured to attach to and to extend longitudinally along a side wall or fascia of the building or house. The horizontal gutter 80 can be attached to a building by way of straps, hangers, brackets or other attachment means. Examples of such attachment means are shown in FIGS. 6A, 6B and 6C.

The one or more see-through sections may be longitudinally positioned in the gutter and will extend from one end of the gutter to the other end of the gutter. The see-through sections may be transparent or translucent, such that debris build-up in the gutter is visible to a viewer of the gutter, such a as a homeowner or a profession in the industry. In embodiments of the present invention, any transparent or translucent see-through section in a gutter may be coloured. The colour of the see-through section may be a colour that enhances the visibility of objects or items in the gutter, and of debris build-up in the gutter.

The see-through sections may further be fully incorporated in the gutter, for example such as in a seamless manner. As an example, the see-through sections may be incorporated in the gutter through a process whereby the see-through sections are integrated with opaque sections, for example, such as by a co-extrusion process or injection moulding. Moreover, see-through sections that are transparent or translucent can be incorporated with opaque sections in a similar manner in other elements of a gutter system, such as a downspout, elbow or a middle component.

Figures 9A, 9B, 9C:
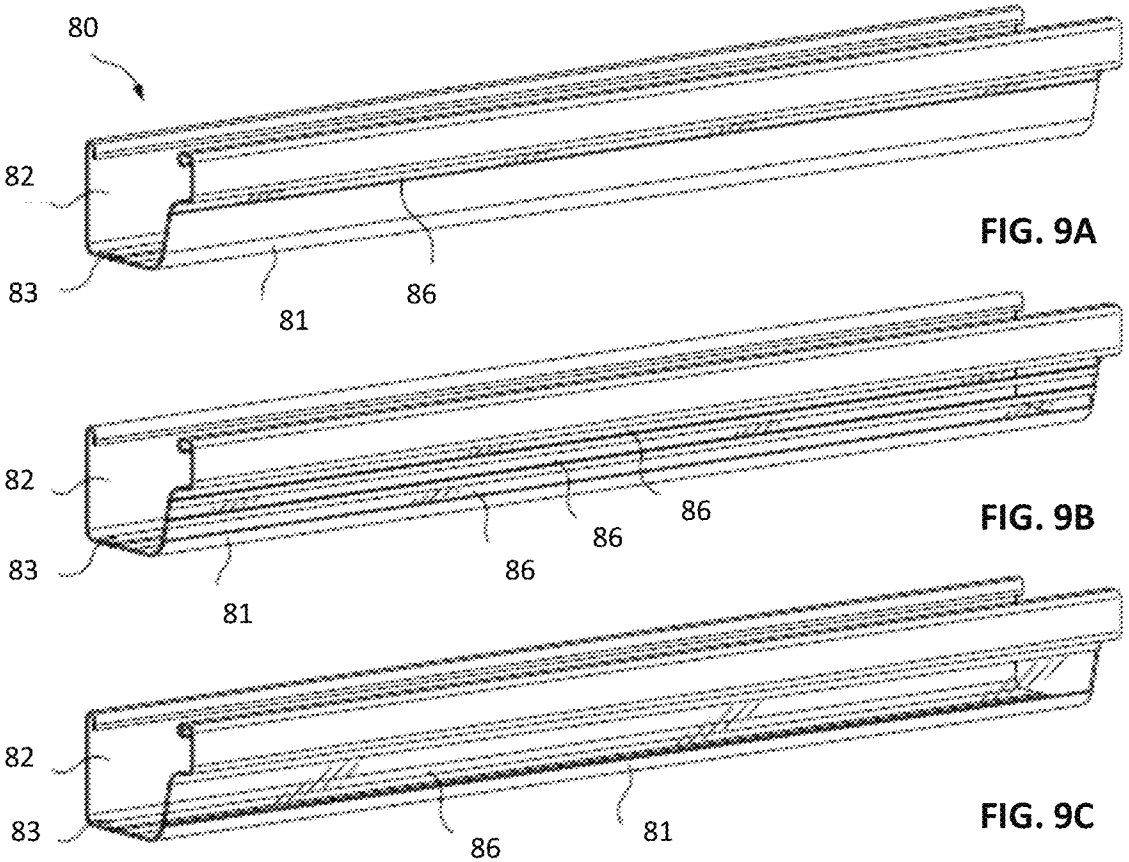
FIG. 9A shows a perspective view of a gutter incorporating a see-through strip extending from end to end, in accordance with an embodiment of the present invention.
FIG. 9B shows a perspective view of a gutter incorporating a plurality of see-through strips extending from end to end, in accordance with an embodiment of the present invention.
FIG. 9C shows a perspective view of a gutter incorporating a wide see-through strip extending from end to end, in accordance with an embodiment of the present invention.
Figure 10:
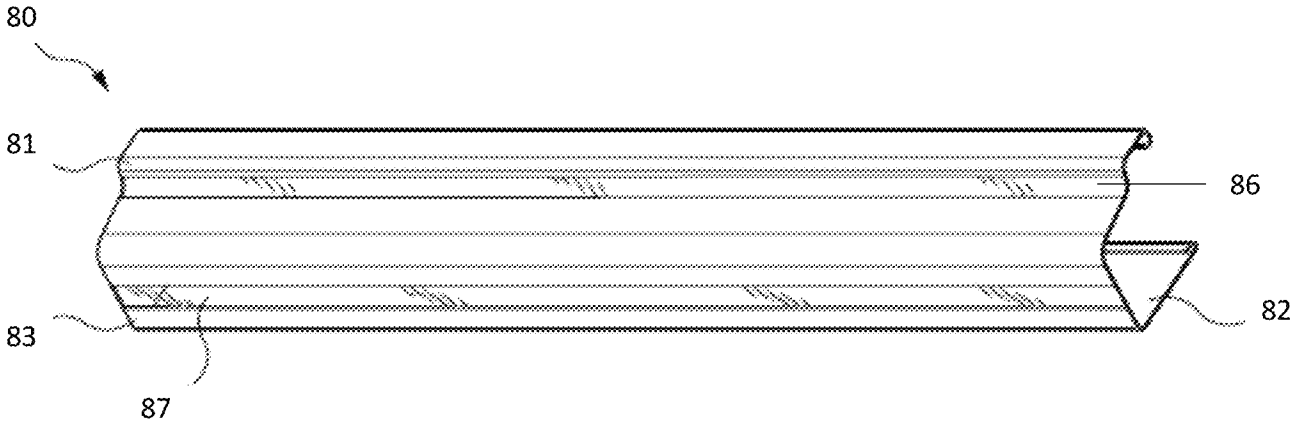
FIG. 10 shows a bottom perspective view of a gutter incorporating see-through strips extending from end to end along the front side and the bottom side of the gutter, in accordance with an embodiment of the present invention.

In embodiments of the present invention, one or more see-through sections, being transparent or translucent strips 86 are incorporated in the front wall 81 of a gutter in a longitudinal position. Examples of an embodiment of the present invention that is a gutter 80 incorporating one transparent or translucent strip 86 in the front wall 81, are shown in FIGS. 9A, 9C and 10. The transparent or translucent strip may be of varying sizes in embodiments of the present invention, and may encompass a significant portion of the front wall, as shown in FIG. 9C. An example of another embodiment of the present invention, that is a gutter incorporating multiple see-through sections that are transparent or translucent strips 86 in the front wall 81, is shown in FIG. 9B. The transparent or translucent strips extend fully longitudinally along the front wall of the gutter, right to the edges of the front wall of the gutter.

In an embodiment of the present invention the gutter may further incorporate one or more see-through sections that are transparent or translucent strips 87 in the base 83 of the gutter, as shown in FIG. 10. The base of the gutter is attached to the front wall 81 and the back wall 82 of the gutter. The back wall of the gutter being the wall that will be positioned closest to the building when the gutter is installed in a building, and the front wall is opposite the back wall. The transparent or translucent strips extend fully longitudinally along the base of the gutter, right to the edges of the base of the gutter.

Figures 11A, 11B, 12:
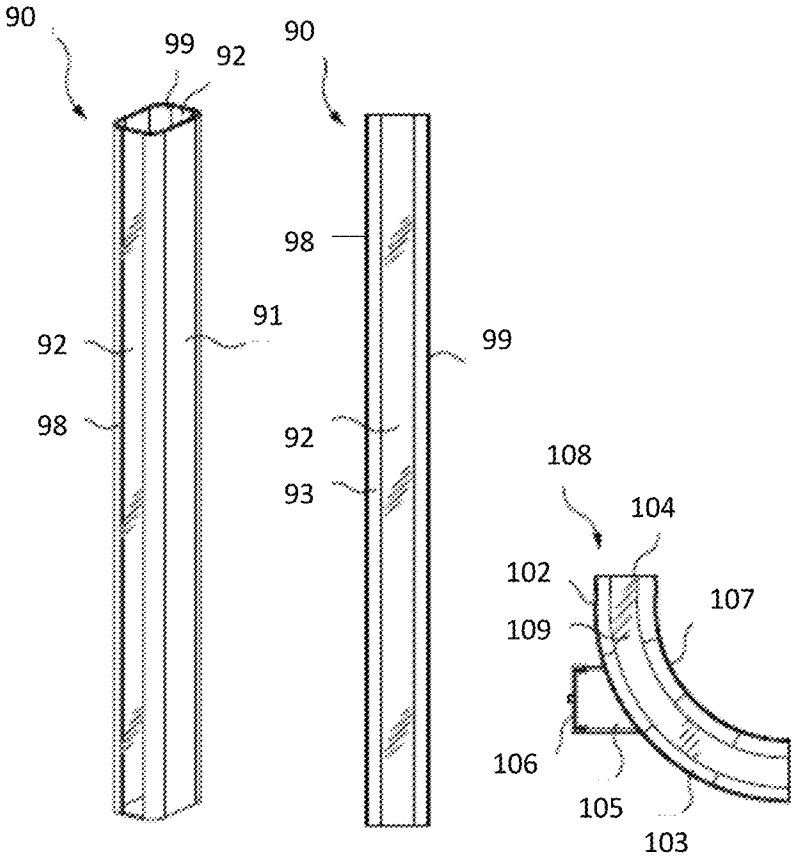
FIG. 11A shows a perspective view of a downspout incorporating a see-through strip in two side walls extending from end to end, in accordance with an embodiment of the present invention.
FIG. 11B shows a side view of a downspout incorporating a see-through strip extending from end to end in a side wall, in accordance with an embodiment of the present invention.
FIG. 12 shows a side view of an elbow section incorporating a see-through strip in a side wall extending from end to end, in accordance with an embodiment of the present invention.
Figure 13:
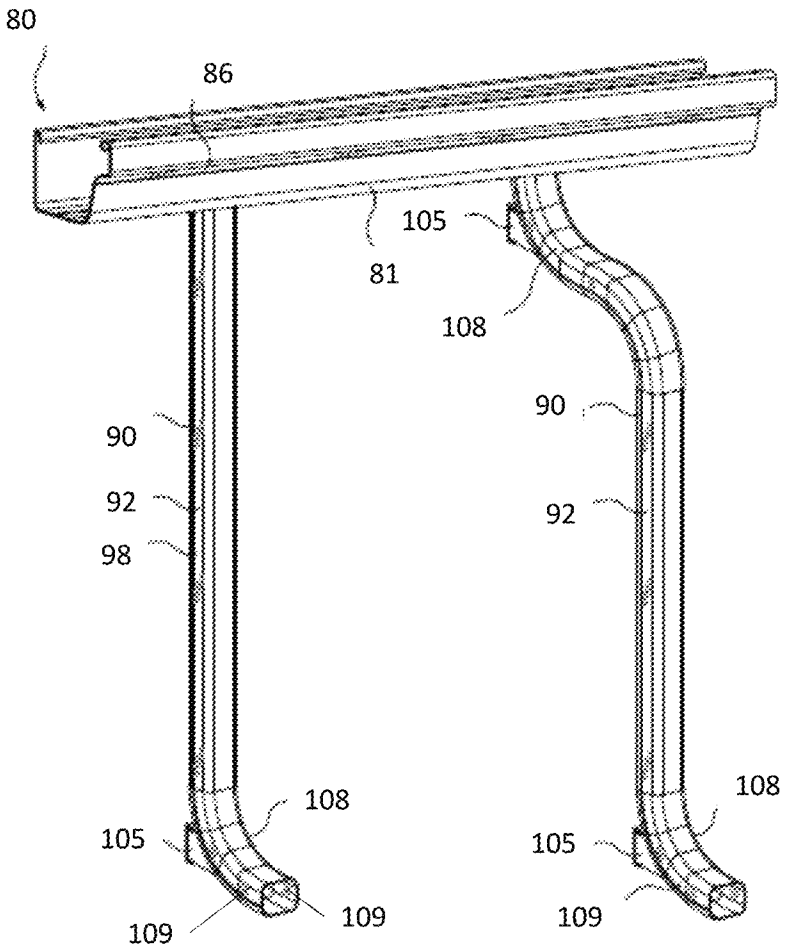
FIG. 13 shows a perspective view of the gutter system incorporating a plurality of downspouts attached to a gutter, and further incorporating see-through strips extending from end to end, in accordance with an embodiment of the present invention.

FIGS. 11A and 11B show the downspout 90 of an embodiment of the present invention. The downspout 90 is an enclosed channel that may be have a spherical, rectangular, or other shape formed by its walls. The enclosed channel functions as a tubular trough and may be positioned vertically on the side wall of a building to direct water flow downward from the horizontal gutter. As shown in FIGS. 11A and 11B, a downspout comprises a front wall 93, a left wall 98, a right wall 99 and a rear wall 91.

The downspout 90 of the present invention has at least one see-through section, being a transparent or translucent strip 92, longitudinally incorporated in the one or both of the side walls 98, 99 of the downspout, as shown in FIG. 11A. The see-through sections extend from one end of the downspout to the other end of the downspout. The downspout 90 of the present invention may have at least one see-through section, being a transparent or translucent strip 92, longitudinally incorporated in the front wall 93, as shown in FIG. 11A. The front wall of the gutter is the wall that will be positioned opposite the wall of the downspout that is positioned closest to the building when the downspout is installed in a building. The see-through sections may further be incorporated in the downspout, for example, such as in a seamless manner. As an example, the see-through sections may be incorporated in the downspout through a process whereby the see-through sections are integrated with opaque sections, such as by a co-extrusion process or by injection moulding. In embodiments of the present invention, any transparent or translucent see-through section in a downspout may be coloured. The colour of the see-through section may be a colour that enhances the visibility of objects or items in the downspout, and of debris build-up in the gutter.

Various configurations of elbow sections are possible in the present invention, and as elements to be configured into gutter systems generally. Embodiments of an elbow section having an extended access port are shown in FIGS. 7A, 7B, 7C, and 7D. Such an embodiment of the elbow incorporates an access port having walls 55 that extend outwardly from the outside wall of the gutter wherein the access port is positioned. An access port closure, such as a cap, 56 is attachable to the access port closure.

Another embodiment of an elbow section is shown in in FIGS. 14A, 14B, 14C, 15A, 15B, 16A, 16B, 16C, 17A, 17B, 18A, 18B, 18C, 19, 20A, and 20B, having an elbow 108 generally has an inner-bend wall 120, an outer-bend wall 102, and side walls 103, 104, and may be bent at a variety of angles (i.e., the angle of the bend may be any of a variety of degrees of angles). The elbow 108 may incorporate an access port 105 that is closed by an access port closure 106*a*, 106*b*, 106*c* or a cap 56. In such embodiments of the elbow section, the access port is parallel with or virtually parallel with the outer portion of the wall of the elbow section wherein the access port is positioned.

Yet another embodiment of an elbow section is shown in FIGS. 22A, 22B, 22C, 23A, 23B, 24, 25A, 25B, 26A, 26B, and 27, wherein the elbow incorporates an extended mid-section.

Embodiments of elbows of the present invention may further incorporate one or more see-through sections, being transparent or translucent strips 109, in one or more of the inner-bend wall, the outer-bend wall, and/or the side walls. Translucent or transparent strips may be positioned in one or more walls of the elbow. In embodiments of the present invention the elbow may be wholly formed of opaque material, or may be wholly formed of transparent material, or may be wholly formed of translucent material, or may be formed of opaque material incorporating one or more see-through sections.

Embodiments of an elbow that incorporates one or more see-through sections that are transparent or translucent strips, may incorporate such see-through sections as positioned to align or virtually align with any see-through sections in any downspout, or middle component, to which the elbow is attached. Should the see-through sections be so positioned in an elbow, when the elbow is connected to or otherwise attached with the downspout or middle component, a consistent or virtually consistent see-through section, that may be wholly transparent or translucent, or a combination of transparent and translucent, will extend along the downspout and the elbow, or middle component and the elbow. It is also possible for elbows that incorporate one or more see-through sections to have such see-through sections incorporated therein so as to be positioned such that the see-through sections are not aligned with any one or more see-through sections in any downspout or middle component that the elbow may be connected to or otherwise attached with.

In embodiments of the gutter system of the present invention, a gutter 80 incorporating at least one transparent or translucent strips 86 in a front wall 81, may have one or more downspouts 90 attached thereto. Said downspouts 90 may incorporate one or more see-through sections 92, such as in a side wall 98. Said downspouts may further have at least one elbow 108 attached thereto. The elbow may incorporate an access port 105, and may further incorporate one or more see-through sections 109, or be wholly formed of opaque, transparent or translucent material.

Embodiments of elbows of the present invention may be of various shapes, and such configuration of the elbow may incorporate one or more ends shaped so as to be attachable to a downspout or a middle component, such as shaped to a specific adapter shape, or some other shape. As discussed herein, elbow sections may be formed entirely of an opaque material, entirely of a transparent or translucent material, or may be formed of an opaque material incorporating one or more see-through sections therein.

The central portion of the elbow may incorporate an access port 105. A variety of types of access port closures 106*a*, 106*b*, 106*c* may be configured to fit within the access port, and thereby close the access port. The access port closure may further be configured to seal the access port when the access port closure is inserted into the access port.

The access port may thereby be closed, such that liquid and debris flowing within the elbow may not or may be impeded from exiting or leaking from the access port.

Figure 21:
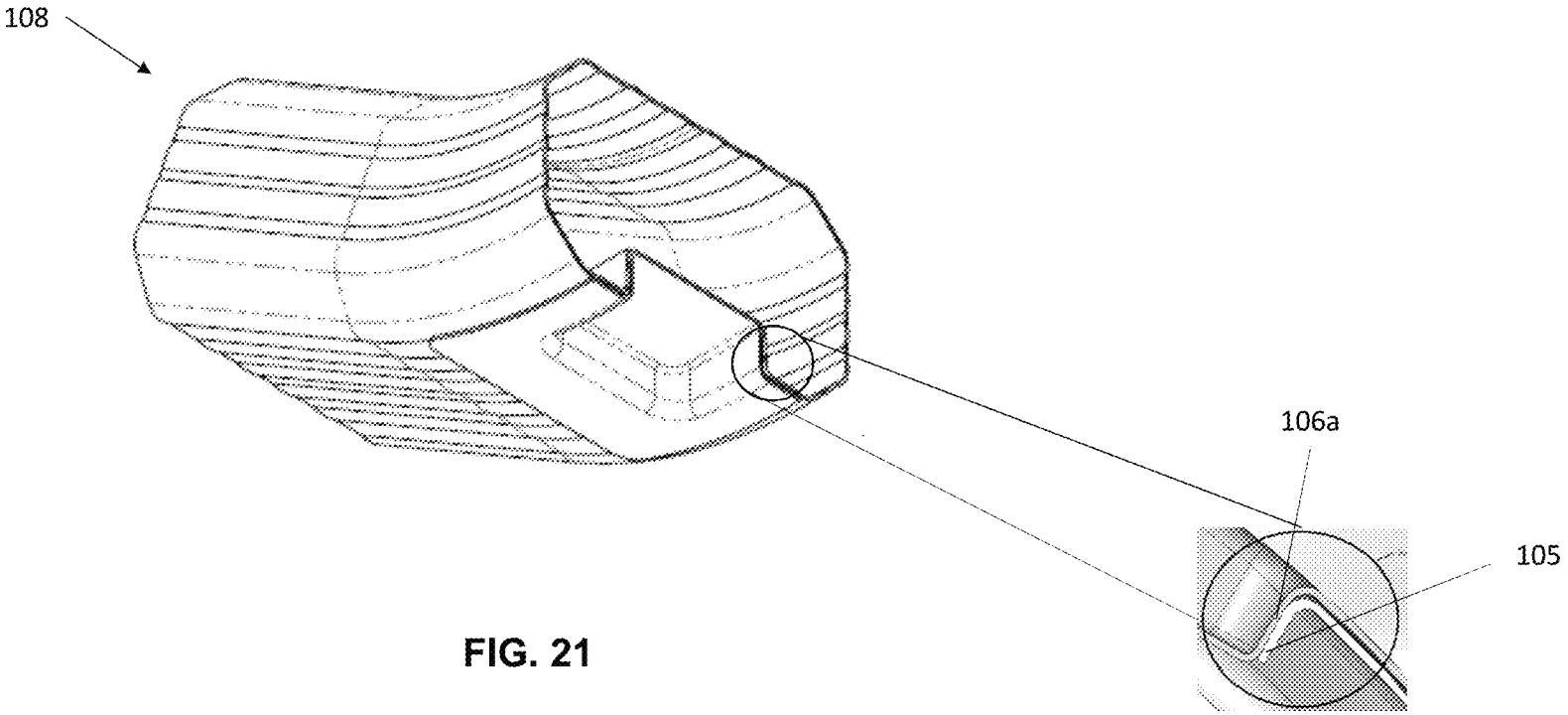
FIG. 21 shows a perspective view of an elbow section and a detailed view of the access port closure inserted into the access port creating a friction seal therebetween, in accordance with an embodiment of the present invention.
Figure 22B:
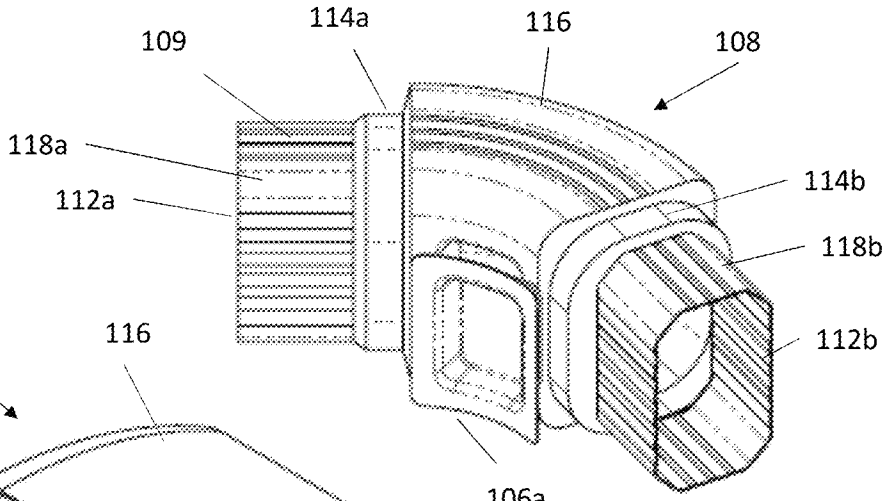
FIG. 22B shows a perspective view of an elbow section having an enlarged midsection incorporating an access port and access port closure in an inner-bend wall, and further incorporating at least one see-through strip, in accordance with an embodiment of the present invention.
Figure 22C:
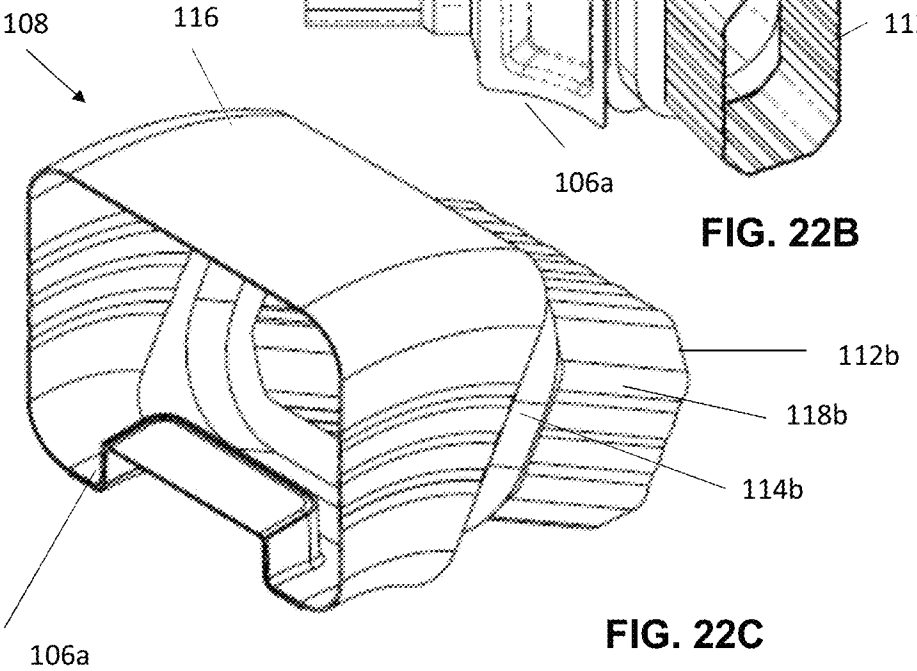
FIG. 22C shows a perspective view of an elbow section having an enlarged midsection incorporating an access port and access port closure in an inner-bend wall, in accordance with an embodiment of the present invention.
Figure 22A:
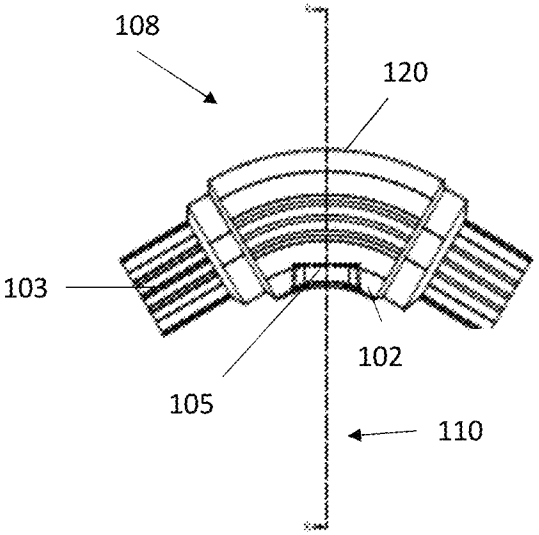
FIG. 22A shows a perspective view of an elbow section having an enlarged midsection indicating the placement of the access port in the inner-bend wall.
Figure 23A:
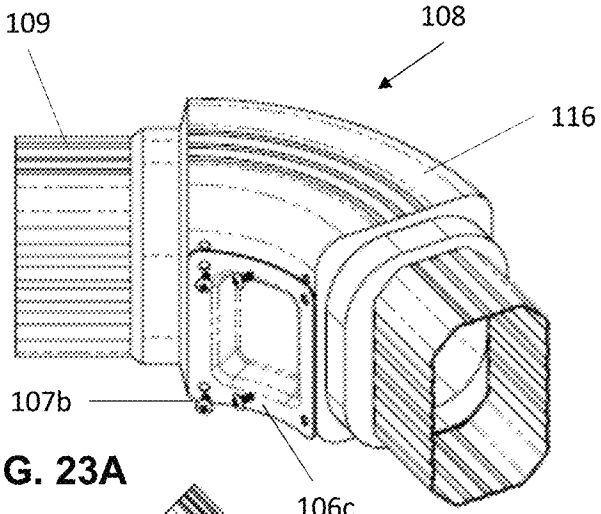
FIG. 23A shows a perspective view of an elbow section having an enlarged midsection incorporating an access port and access port closure in an inner-bend wall, said access port closure being attachable by screws, and further incorporating see-through strips, in accordance with an embodiment of the present invention.
Figure 23B:
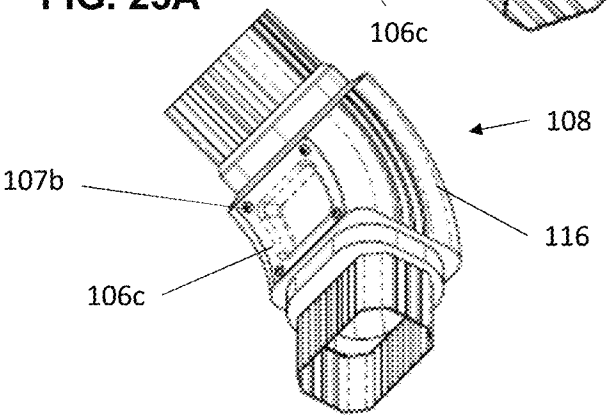
FIG. 23B shows a perspective view of an elbow section having an enlarged midsection incorporating an access port and access port closure in an inner-bend wall, said access port closure being attached by screws, and further incorporating see-through strips, in accordance with an embodiment of the present invention.
Figure 25A:
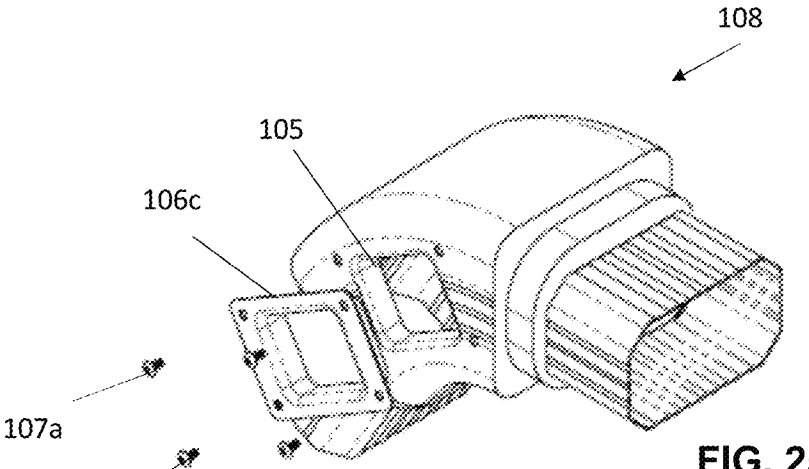
FIG. 25A shows a perspective view of an elbow section having an enlarged midsection incorporating an access port and access port closure in a side wall, said access port closure being attachable by screws, in accordance with an embodiment of the present invention.
Figure 25B:
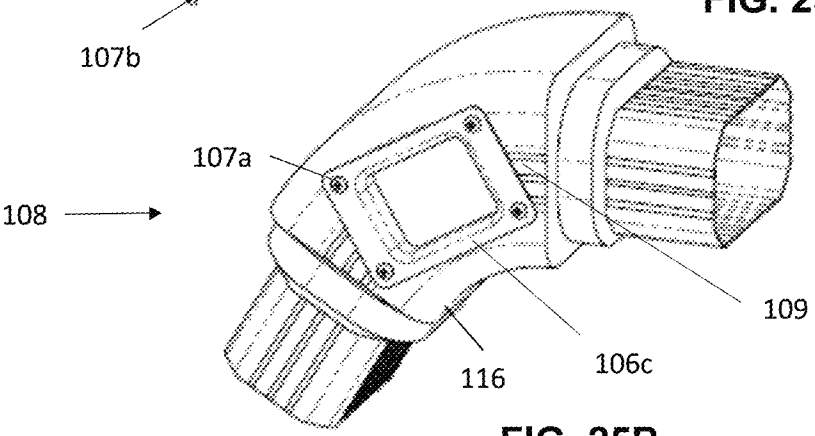
FIG. 25B shows a perspective view of an elbow section having an enlarged midsection incorporating an access port and access port closure in a side wall, said access port closure being attached by screws, in accordance with an embodiment of the present invention.
Figure 24:
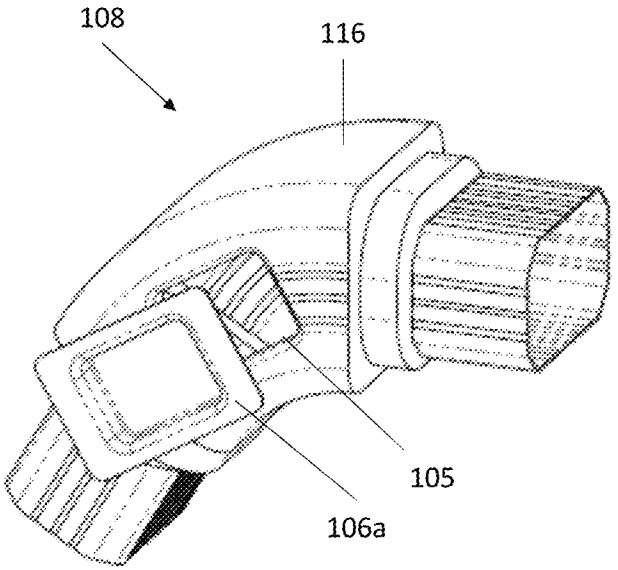
FIG. 24 shows a perspective view of an elbow section having an enlarged midsection incorporating an access port and access port closure in a side wall, in accordance with an embodiment of the present invention.
Figure 27:
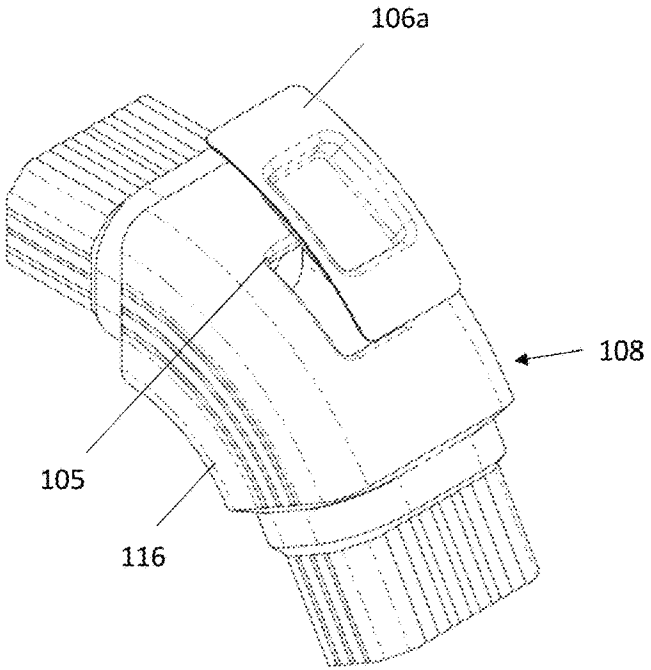
FIG. 27 shows a perspective view of an elbow section having an enlarged midsection incorporating an access port and access port closure in an outer-bend wall, in accordance with an embodiment of the present invention.
Figure 26A:
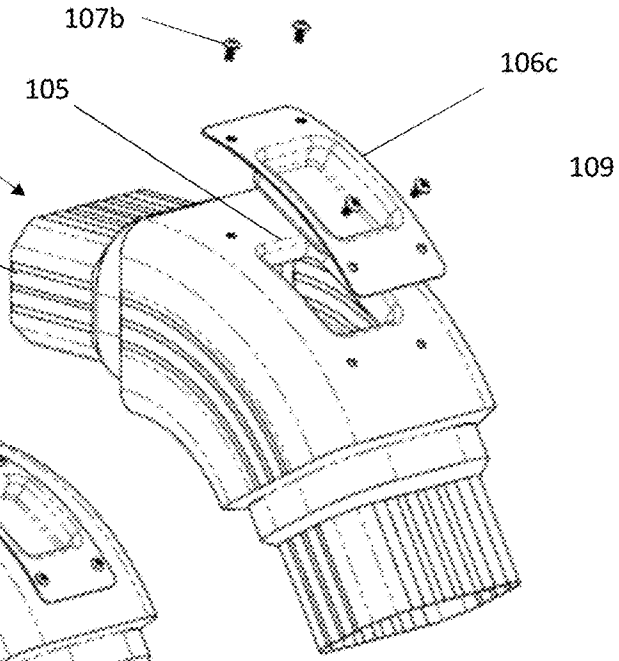
FIG. 26A shows a perspective view of an elbow section having an enlarged midsection incorporating an access port and access port closure in an outer-bend wall, said access port closure being attachable by screws, and further incorporating at least one see-through strip, in accordance with an embodiment of the present invention.
Figure 26B:
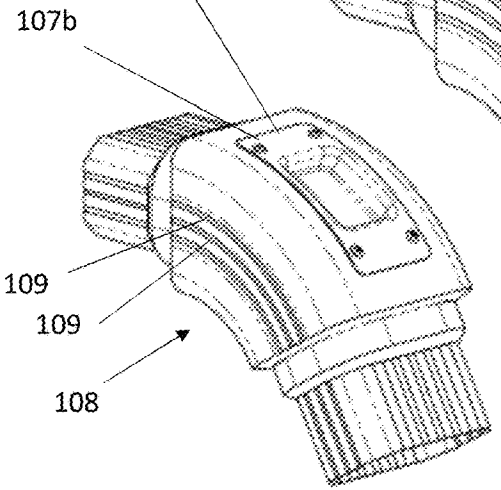
FIG. 26B shows a perspective view of an elbow section having an enlarged midsection incorporating an access port and access port closure in an outer-bend wall, said access port closure being attached by screws, and further incorporating transparent or translucent strips, in accordance with an embodiment of the present invention.

The access port closure may seal the access port by a variety of means. For example, the access port closure may seal the access port by friction between the contact of the access port closure with the access port 105 (as shown in FIGS. 14A-C, 15, 16A-16B, 17A-17B, 18A-18C and 19). FIG. 21 shows a detailed view of the friction fit between an access port 105 and an access port closure 106*a*. The access port 105 may incorporate a wall or other configuration that is wholly or partially in contact with a portion of the access port closure 56, 106*a*, 106*b*, 106*c*. The contact of the access port and a portion of the access port closure may create friction therebetween. Specifically friction will exist between the portions of the wall of the access port and the wall of the access port closure that are in direct contact with each other. The friction is sufficient to create a seal between the portions of the wall of the access port and the wall of the access port closure that are in contact. The seal will act to impede liquid or other content flowing within the elbow from exiting or otherwise leaking out of the interior of the elbow. In some embodiments of the present invention, the seal created by a friction fit access port closure inserted into an access port may be sufficiently tight, such that liquid and debris flowing through the elbow cannot exit the elbow through the access port.

Figure 19:
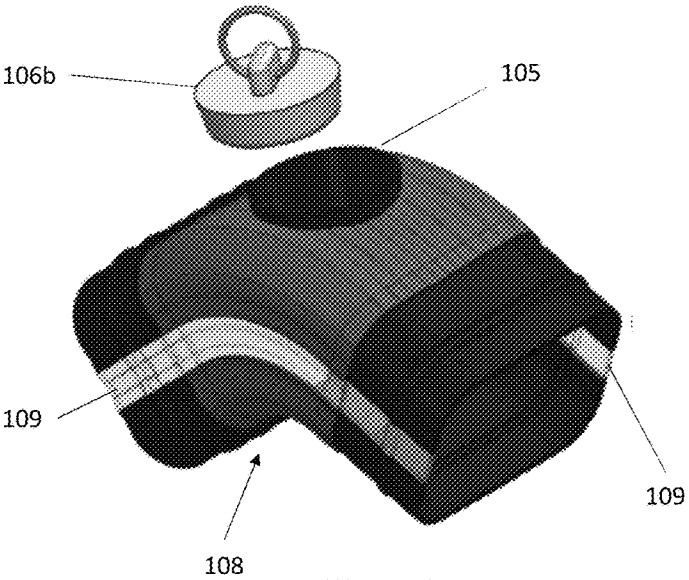
FIG. 19 shows a perspective view of an elbow section incorporating an access port in the outer-bend wall and an access port closure that is a plug, and further incorporating at least one see-through strip, in accordance with an embodiment of the present invention.
Figure 18C:
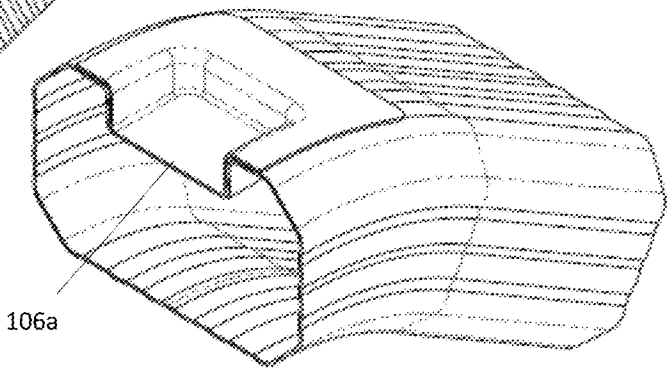
FIG. 18C shows a cross-section view of an elbow section incorporating an access port in the outer-bend wall with the access port closure inserted into the access port, in accordance with an embodiment of the present invention.
Figure 18A:
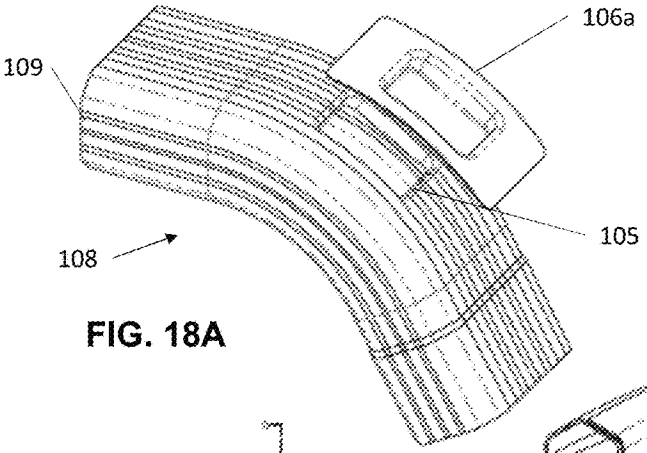
FIG. 18A shows a perspective view of an elbow section incorporating an access port and access port closure in the outer-bend wall, and further incorporating at least one see-through strip, in accordance with an embodiment of the present invention.
Figure 18B:
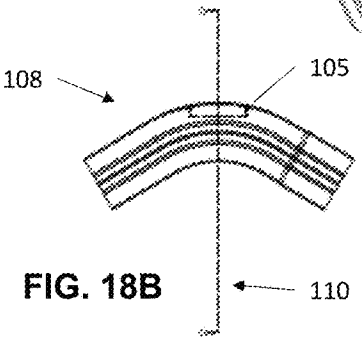
FIG. 18B shows a perspective view of an elbow section indicating the placement of the access port in the outer-bend wall, in accordance with an embodiment of the present invention.
Figures 20A, 20B:
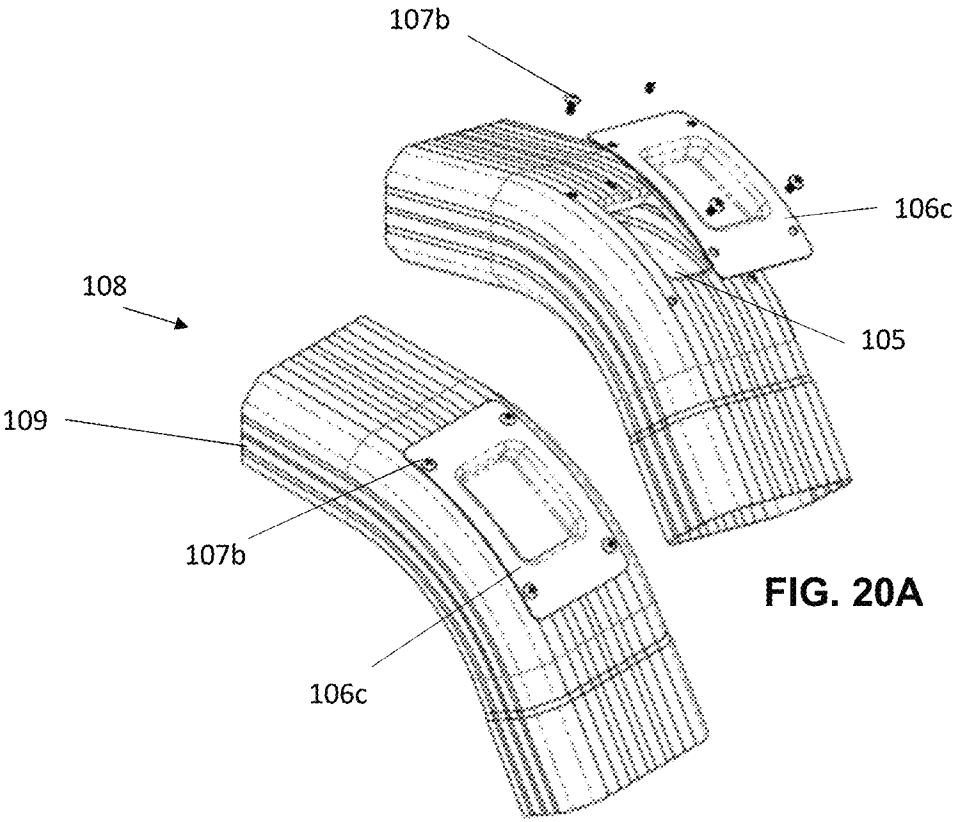
FIG. 20A shows a perspective view of an elbow section incorporating an access port and access port closure in an outer-bend wall, said access port closure being attachable by screws, in accordance with an embodiment of the present invention.
FIG. 20B shows a perspective view of an elbow section incorporating an access port and access port closure in an outer-bend wall, said access port closure being attached by screws, and further incorporating at least one see-through strip, in accordance with an embodiment of the present invention.

The access port closure can be of any type, including an access port closure that is a cap 56 as shown in FIGS. 7A-7D, or a plug 106*b* as shown in FIG. 19, or a friction fit access port closure as shown in FIGS. 14A-21, or any combination thereof. Any type of access port closure may be secured to a wall of the elbow, for example, such as by screws 107*a*, 107*b*, 107*c*, 107*d* or some other attachment means operable to secure the access port closure to a wall of the elbow, as shown in FIGS. 15A-15B, 17A-17B, 20A-20B, 23A-23B, 25A-25B and 26A-26B. Securing the access port closure to a wall of the elbow will act to keep the access port closure in position, to keep the access port closed.

In another embodiment of the elbow of the present invention, the access port closure 106*c* may be attached to the elbow 108 so as to cover the access port 105, such as by screws 107*a*, 107*b*, 107*c*, 107*d* or other attachments (as shown as detached in FIGS. 20A, 21A, 22A, 23A, 24A and 25A, and as attached in FIGS. 20B, 21B, 22B, 23B, 24B and 25B).

As shown in FIGS. 14B, 16C, 18B and 22A, in some embodiments of the present invention, the access port 105 may be positioned centrally 110 or virtually centrally in the relation to the bend of the elbow 108.

The access port closure 106*a*, 106*b*, 106*c* may further be configured to extend into the elbow section when fitted with the access port, as shown in detail in cross-section in FIGS. 14C, 16B, 18C, 21, and 22C.

The access port closure may be formed of any material, for example, such as polyvinyl chloride (PVC), rubber, acrylic, or polyethylene.

The access port closure may be removed from the access port to provide access to the interior of the elbow. Debris contained within the interior of the elbow may be removed from the elbow through the access port when the access port closure is removed. Once the debris is removed from the elbow or any downspout or middle component through the access port, the access port closure can be returned to close the access port. The debris in the interior of the elbow may be viewed through the one or more see-through sections that may be incorporated in some embodiments of the elbow of the present invention.

The access port 105 may be positioned in any wall of an elbow, such as any side wall (as shown in FIGS. 14A-14C, 15A-15B, 24 and 25A-25B), an inner-bend wall (as shown in FIGS. 16A-16C, 17A-17B, 22A-22C, and 23A-23B), or an outer-bend wall (as shown in FIGS. 18A-18C, 19, 20A-20B, 21, 26A-26B, and 27).

Figure 14C:
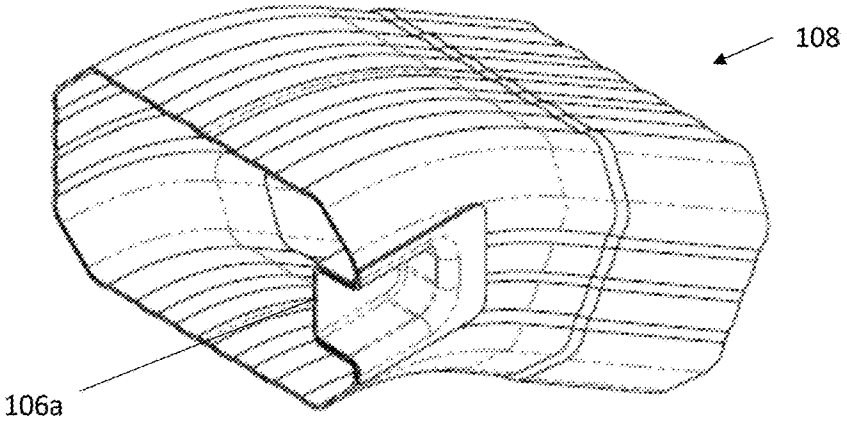
FIG. 14C shows a cross-section view of an elbow section incorporating an access port in a side wall with the access port closure inserted into the access port, in accordance with an embodiment of the present invention.
Figure 14A:
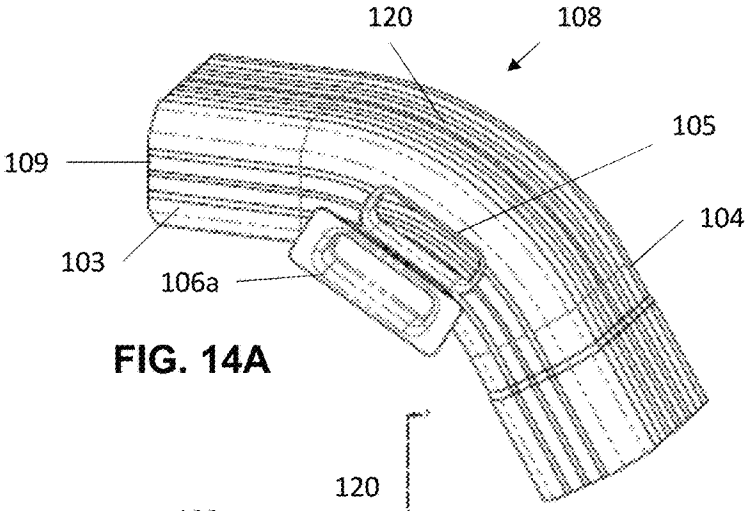
FIG. 14A shows a perspective view of an elbow section incorporating an access port in a side wall, and further incorporating at least one see-through strip extending from end to end, in accordance with an embodiment of the present invention.
Figure 14B:
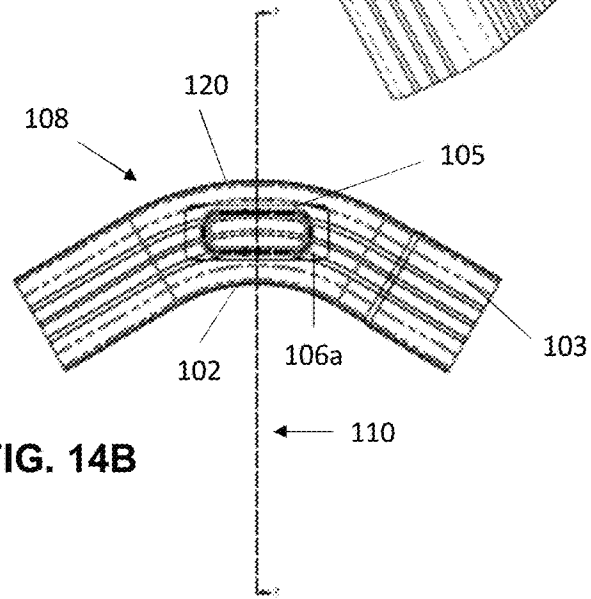
FIG. 14B shows a perspective view of an elbow section indicating the placement of the access port in a side wall, in accordance with an embodiment of the present invention.
Figure 15A:
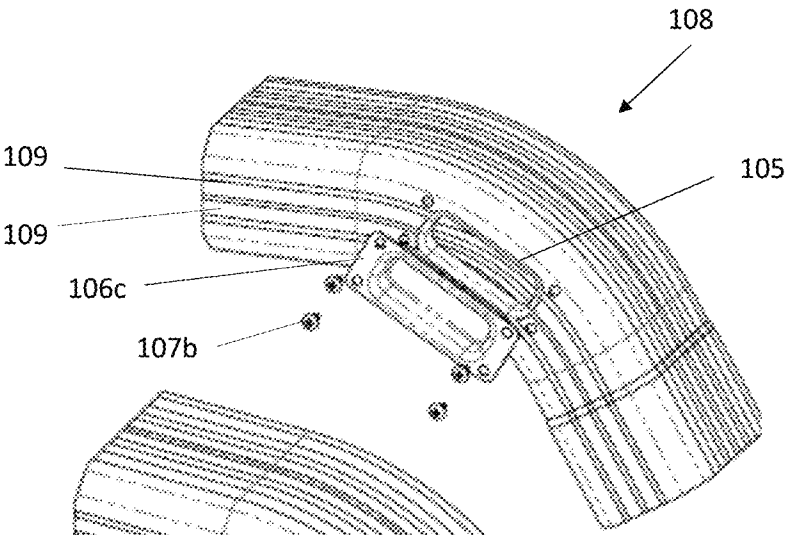
FIG. 15A shows a perspective view of an elbow section incorporating an access port and access port closure in a side wall, said access port closure being attachable by screws, in accordance with an embodiment of the present invention.
Figure 15B:
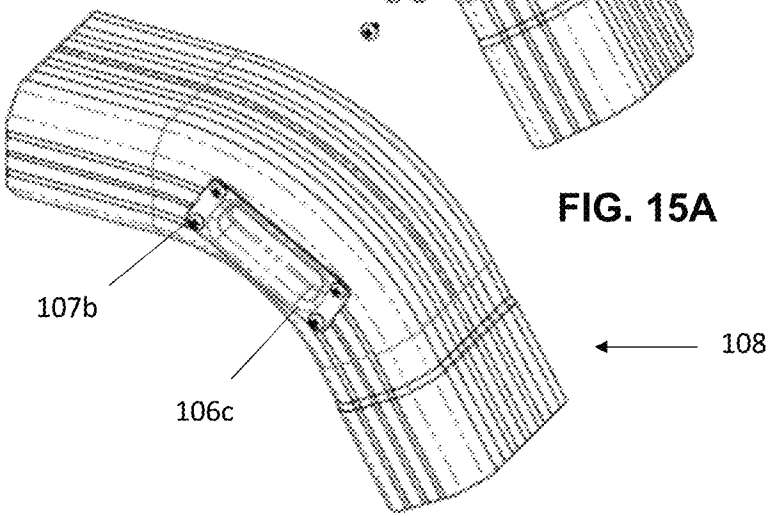
FIG. 15B shows a perspective view of an elbow section incorporating an access port and access port closure in a side wall, said access port closure being attached by screws, in accordance with an embodiment of the present invention.
Figure 17A:
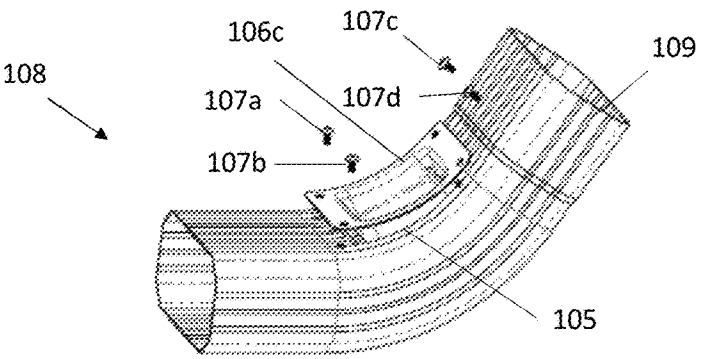
FIG. 17A shows a perspective view of an elbow section incorporating an access port and access port closure in an inner-bend wall, said access port closure being attachable by screws, and further incorporating at least one see-through strip, in accordance with an embodiment of the present invention.
Figure 17B:
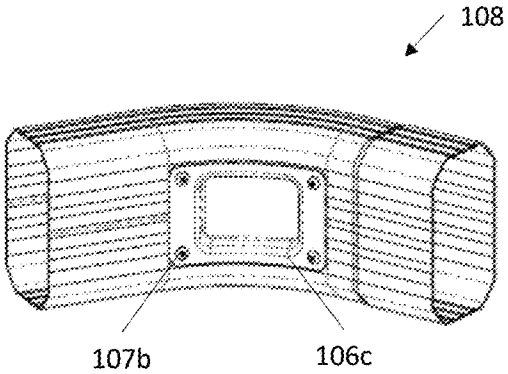
FIG. 17B shows a perspective view of an elbow section incorporating an access port and access port closure in an inner-bend wall, said access port closure being attached by screws, in accordance with an embodiment of the present invention.
Figure 16C:
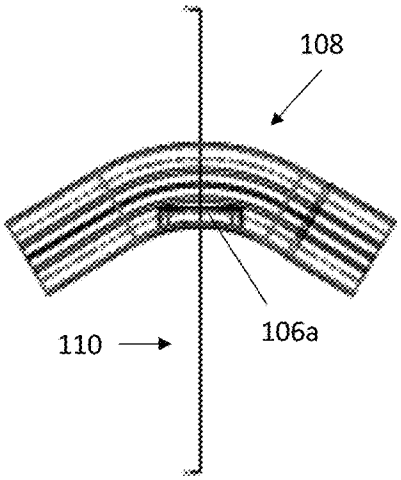
FIG. 16C shows a perspective view of an elbow section indicating the placement of the access port in an inner-bend wall, in accordance with an embodiment of the present invention.
Figure 16A:
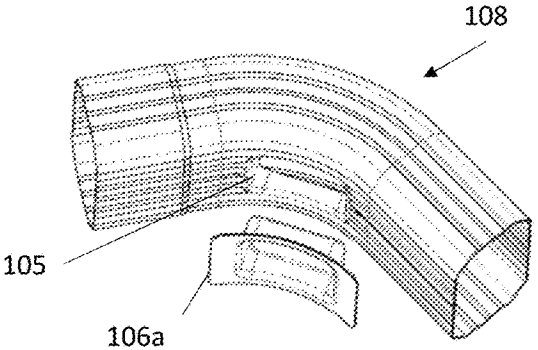
FIG. 16A shows a perspective view of an elbow section incorporating an access port and access port closure in the inner-bend wall, in accordance with an embodiment of the present invention.
Figure 16B:
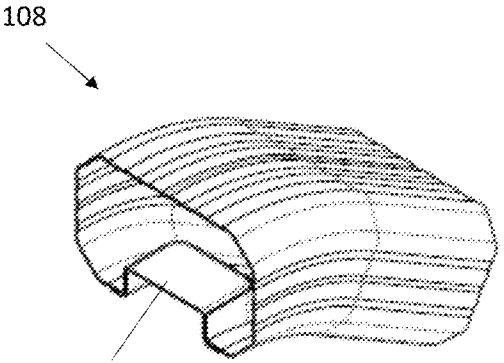
FIG. 16B shows a cross-section view of an elbow section incorporating an access port in the inner-bend wall with the access port closure inserted into the access port, in accordance with an embodiment of the present invention.

As shown in FIGS. 22A-27, embodiments of an elbow 108 of the present invention may incorporate a middle section 116 that is larger in diameter than the diameter of the one or more of ends 112*a*, 112*b* of the elbow. Such embodiment of the present invention incorporate an enlarged midsection. This configuration therefore differs from the configuration of an elbow as shown in FIG. 14A wherein the whole of the elbow is the a consistent diameter, or virtually consistent diameter.

As shown in FIGS. 22*a*-27, in embodiments of an elbow of the present invention incorporating an enlarged midsection, one or more of the ends 112*a*, 112*b* of the elbow that are lesser in diameter than the middle section may be configured to be attachable to a downspout, middle component, or a gutter. A downspout attachment section 118*a*, 118*b* extending from the one or more the ends towards the middle section that are attachable to a downspout, middle component, or gutter, may further be configured to be attachable to a downspout, middle component and/or gutter. An expansion section 114*a*, 114*b* may be positioned between a downspout attachment section and a middle section (i.e., the middle section being the enlarged midsection portion of the elbow). Each expansion section may be configured to provide a gradual slope towards the middle section, and/or may incorporate one or more steps that create a change in the diameter of elbow so as to progress from the diameter of the downspout attachment section to the diameter of the middle section.

Such embodiments of the elbow may incorporate access ports positioned in either of the side walls, the inner-bend wall, or the outer-bend wall of the midsection, and the access ports may be closed and sealed by an access port closure of any type, including any of the types of access closure ports discussed herein.

Some embodiments of the elbow of the present invention incorporating an enlarged midsection may further incorporate one or more see-through sections, that may be formed of transparent or translucent materials, as shown in FIGS. 22B, 23A, 25B, and 26A-26B. The see-through sections may extend from one end of the elbow to the other end of the elbow. The see-through sections may further align, or not align, with any see-through sections that may exist in any downspout or middle component that is attached to an end of the elbow, in the manner described herein for alignment of see-through sections. Any see-through section incorporated in an elbow may furthermore be incorporated so as to be fully incorporated in the elbow, for example such as in a seamless manner, and such that the see-through section extends from one end of the elbow to the opposite end of the elbow. As an example, the one or more see-through sections may be incorporated in the elbow through a process whereby the see-through sections are integrated with opaque sections, such as by a co-extrusion process or by injection moulding. Any transparent or translucent see-through section in an elbow may be coloured. The colour of the see-through section may be a colour that enhances the visibility of objects or items in the elbow.

The middle section of such an embodiment of an elbow of the present invention having an enlarged midsection, may offer the benefit of generating better flow of liquid (i.e., water) and debris through the elbow. As discussed herein, elbows can be prone to clogging when debris build-up occurs due to debris becoming stuck, or otherwise accumulating in the elbow. This can occur due to the bend in the elbow, whereby the flow of the liquid and the debris is altered and the force of gravity upon the flow decreases due to the alteration in the angle of the flow created by the bend in the elbow.

The middle section of the elbow of an embodiment of the present invention that incorporates an enlarged midsection, is larger in diameter from the one or more downspout attachment sections of the elbow. The middle section therefore allows for more room within the elbow for liquid and debris to flow through. The middle section creates an enlarged chamber within the elbow that allows for more debris and water to flow through the elbow. Due to the increase amount of liquid that the enlarged chamber permits to flow through the middle section of the elbow, the overall flow of the debris through elbow downwards is enhanced. The added space for water to flow through in the enlarged chamber helps to push debris through the elbow downwards and out of the elbow towards the ground surface.

The expansion section 114*a*, 114*b* of this configuration of an elbow of the present invention, may incorporate one or more ledges or lips within the interior portion of the elbow. Such ledges or lips may be of a minor size, such that the effect of any such ledges or lips would be negligible upon the flow of liquid or debris within the elbow. Therefore, it would be hard for any debris to get caught on any such ledges or lip when flowing through the elbow. Moreover, the increased pressure in the flow of the liquid within the elbow, caused by the increase amount of liquid able to flow through the enlarged midsection of the elbow, and the fact that the initial flow of such liquid would be in a vertical direction before the bend in the elbow, would act to force the debris through the elbow, and keep it from becoming lodged on any ledges or lips within the elbow.

Another benefit of the configuration of the elbow incorporating an enlarged midsection is that during heavy rains, or when snow melts, such rain or melting snow captured in the gutter flowing towards the elbow, enters the elbow with an enlarged midsection that allows more water to flow through it and for such water to flow at a faster rate than occurs within an elbow that does not incorporate an enlarged midsection. This has the benefit of taking pressure off of the gutters and avoiding wear and tear on the gutter system generally that occurs in prior art systems.

Elbows of embodiments of the present invention of any configuration (whether or not including a middle section of greater diameter than any end section of the elbow) may be formed of a plastic material. The plastic material may further assist with the flow of debris. This is due to the fact that if the plastic is wet, such as occurs due to liquid flowing through the elbow, the wet plastic creates a surface having a diminished likelihood of friction between the elbow surface and the liquid or debris flowing through the elbow. Therefore, debris is able to slide through the elbow downwards with less friction. Thus, the flow of the debris and liquid through the elbow is smoother and faster than when the elbow is formed of other materials.

All the benefits described herein relating to elbows of the present invention, including the inclusion of an access port, result in a much more beneficial elbow than prior art elbows.

Embodiments of the gutter system of the present invention, including any elements therefor, such as elbows, downspouts, middle components and gutters, may incorporate a mixture of types of see-through sections, such that a single element may incorporate both transparent and translucent strips.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

With respect to the above description, it is to be realized that the optimum relationships for the parts of the invention in regard to size, shape, form, materials, function and manner of operation, assembly and use are deemed readily apparent and obvious to those skilled in the art, and all equivalent relationships to those illustrated in the drawings and described in the specification are intended to be encompassed by the present invention.

It will be appreciated by those skilled in the art that other variations of the embodiments described herein may also be practiced without departing from the scope of the invention. Other modifications are therefore possible.

What is claimed is:

1. A gutter system for monitoring of debris, said gutter system being positioned proximate to a building, and said gutter system comprising:

a. a gutter trough positioned near-horizontally in relation to the building such that sections of the gutter trough are positioned proximate to one of the one or more side-walls of the building, the gutter trough incorporating three walls including a gutter-base-wall that is connected on its front facing side to a gutter-front-wall and on its opposite rear facing side to a gutter-rear-wall, said gutter-front-wall and said gutter-base-wall each incorporating at least one longitudinal see-through section and an opaque section, the see-through section positioned so as to extend from one end of the gutter trough to an opposite end of the gutter trough; and wherein the see-through section of the gutter-front-wall is spaced an elevated distance from the gutter-base-wall and is separated therefrom by the gutter-front-wall opaque section;

b. one or more downspout troughs, each downspout trough incorporating four walls including a downspout-front-wall positioned opposite to a downspout-rear-wall and being connected to each of two downspout-side-walls that are positioned opposite to each other, the four walls forming an elongate trough, at least one of said downspout-side-walls incorporating at least one longitudinal see-through section extending from one end of the downspout trough to an opposite end of the downspout, and said downspout troughs each having the downspout-rear-wall positioned proximate to one of the side walls of the building and the downspout troughs each being attached to one of the side-walls of the building, and each downspout trough being connected to one of: the gutter trough; another one or more of the one or more downspout troughs; or to one of one or more elbows; and c. each of the one or more elbows being connected to one of: the gutter trough; or one or more of the downspout troughs;

whereby a flow of rainwater and debris is navigated along at least a portion of the gutter trough through a combination of the one or more downspout troughs and the one or more elbows towards a ground surface.

2. The gutter system of claim 1, wherein: (a) the one or more see-through sections of the gutter trough are one of the following: a transparent strip or a translucent strip; (b) the one or more see-through sections of the one or more downspout troughs are a transparent strip or a translucent strip; (c) the see-through sections in the gutter trough are integrated with the gutter trough; and (d) the see-through sections in the one or more downspout troughs are integrated with the downspout trough.

3. The gutter system of claim 1, wherein each of the one or more elbows incorporates four walls including an inner-bend wall positioned opposite an outer-bend wall and being connected to each of two side walls that are positioned opposite to each other.

4. The gutter system of claim 3, wherein one or more of the one or more elbows incorporates one or see-through sections each see-through section being transparent or translucent, or is formed of an opaque, transparent or translucent material, such that the opaque, transparent or translucent section encompasses the whole of the downspout elbow.

5. The gutter system of claim 1, wherein each of the one or more elbows has an access port whereby an interior space of the downspout elbow is accessible, whereby unclogging of a clog in the downspout elbow is achieved.

6. The gutter system of claim 5, wherein the access port is formed as an opening in one of the walls of the elbow, and a removable access port closure is configured to fit over the access port and is attachable to the access port.

7. The gutter system of claim 6, wherein the access port closure is attachable to the elbow by way of a screw connection between the elbow and the access port closure to thereby seal the access port.

8. The gutter system of claim 1, wherein said building is any of the following:

a residential building, a house, or a commercial building.

9. The gutter system of claim 2, wherein the see-through section incorporated in the gutter-front-wall is integrated with the gutter-front-wall opaque section, and the see-though section incorporated in the gutter-base-wall is integrated with the gutter-base-wall opaque section.

10. The gutter system of claim 2, wherein each see-through section of any of the one or more the downspout troughs is incorporated in one or more of the downspout-front-wall, the downspout-rear-wall and the downspout-side-walls.

11. The gutter system of claim 1, wherein a plurality of transparent or translucent elongated brackets or hangers are connected to one of one or more of the side-walls of the building or fascia-board and the gutter trough is supported in proximity to the building by the plurality of transparent or translucent elongated brackets or hangers.

12. The gutter system of claim 11, wherein each of the elongated brackets or hangers incorporates a horizontally extended front grabbing section operable to grab an area of the gutter-front-wall, whereby support of the gutter trough is reinforced and sagging or dislodging of the gutter systems in proximity to the building is deterred.

13. The gutter system of claim 1, wherein the opaque sections are formed of a material or a combination of materials including at least one of the following: metal, plastic, glass, or aluminum.

14. The gutter system of claim 1, wherein the gutter system is formed of a material that is a combination of plastic and glass.

15. The gutter system of claim 1, wherein the gutter system is formed of a material or combination of materials including the following: polycarbonate or polyacrylate.

16. A gutter system for monitoring of rainwater flow and debris in a gutter trough, said gutter system comprising:

a. a gutter trough positioned near-horizontally in relation to the building such that sections of the gutter trough are positioned proximate to one of the one or more side-walls of the building, the gutter trough incorporating three walls including a gutter-base-wall that is connected on its front facing side to a gutter-front-wall and on its opposite rear facing side to a gutter-rear-wall, said gutter-front-wall and said gutter-base-wall each incorporating a longitudinal see-through section and an opaque section, the longitudinal see-through section positioned so as to extend from one end of the gutter trough to the opposite end of the gutter trough; and wherein the see-through section of the gutter-front-wall is spaced an elevated distance from the gutter-base-wall and is separated therefrom by the gutter-front-wall opaque section;

b. one or more downspout troughs, each downspout trough incorporating four walls including a downspout-front-wall positioned opposite to a downspout-rear-wall and being connected to each of two downspout-side-walls that are positioned opposite to each other, the four walls forming an elongate trough, at least one of said downspout-side-walls incorporating a longitudinal see-through section positioned so as to extend from one end of the downspout to the opposite end of the downspout, and said downspout troughs each having the downspout-rear-wall positioned proximate to one of the side-walls of the building and the downspout troughs each being attached to one of the side-walls of the building, and each downspout trough being connected to one of: the gutter trough; another one or more of the one or more downspout troughs; or to one of one or more elbows;

c. the one or more elbows, each of the one or more elbows incorporating four walls including an inner-bend wall positioned opposite an outer-bend wall and being connected to each of two side walls that are positioned opposite to each other, and further incorporating at least one see-through section in at least one of the four walls, and each of the one or more elbows being connected to one of: the gutter trough; or one or more of the downspout troughs;

d. an access port incorporated in at least one of the one or more elbows comprising an opening incorporated in one of the walls of the elbow;

e. a removable access port covering configured to fit over the access port to thereby close the access port; and f. a plurality of transparent elongated brackets each incorporating a grabbing section operable to grab an area of the gutter-front-wall, and each connected to one of the side-walls of the building, and the gutter trough being supported in proximity to the building by said plurality of transparent elongated brackets; and whereby rainwater flow is navigated along at least a portion of the gutter trough through a combination of the one or more downspout troughs and the one or more elbows towards a ground surface.

17. The gutter system of claim 16, wherein the building is any of the following:

a residential building, a house, or a commercial building.

18. The gutter system of claim 16, wherein the plurality of transparent elongated brackets are hangers, and rail hangers are connected to one of one or more side-walls of the building or fascia-board.

19. The gutter system of claim 1, wherein: (a) the one or more see-through sections of the gutter trough are one of the following: a transparent strip, or a translucent strip; (b) the one or more see-through sections of one or more of the one or more downspout troughs are one of the following: a transparent strip, or a translucent strip; (c) the one or more see-through sections of one or more of the one or more elbows are one of the following: a transparent strip, or a translucent strip; (d) the see-through sections in the gutter trough are integrated with the gutter trough; (e) the see-through sections in the one or more downspout troughs are integrated with the downspout; and (f) the see-through sections in the one or more elbows are integrated with the elbows.

20. An elbow section, comprising:

a. four walls including an inner-bend wall positioned opposite an outer-bend wall and being connected to each of two side walls that are positioned opposite to each other, at least one of the four walls incorporating one or more see-through sections and an opaque section;

b. an access port incorporated in at least one of the inner-bend wall, the outer-bend wall or the side walls of the elbow section forming an opening therein; and c. a removable access port covering configured to fit over the access port to thereby close the access port.

21. The elbow section of claim 20, wherein: (a) the one or more see-through sections of the elbow section are one of the following: a transparent strip, or a translucent strip; (b) at least one end of the elbow section is configured to attach to a downspout trough or a gutter trough; and (c) one or more see-through sections are incorporated in at least one of the inner-bend wall, the outer-bend wall, or the side walls, said one or more see-through sections extending from one end of the elbow to an opposite end of the elbow section, and such see-through sections being integrated with the elbow section and being either transparent or translucent.

22. An elbow section, comprising:

a. four walls including an inner-bend wall positioned opposite an outer-bend wall and being connected to each of two side walls that are positioned opposite to each other, and configured to incorporate an enlarged midsection, at least one of the four walls incorporating one or more see-through sections and an opaque section;

b. an access port incorporated in at least one of the inner-bend wall, the outer-bend wall or the side walls of the elbow section forming an opening therein; and c. a removable access port covering configured to fit over the access port to thereby close the access port.

23. The elbow section of claim 22, wherein: (a) the one or more see-through sections of the elbow section are one of the following: a transparent strip, or a translucent strip; (b) at least one end of the elbow section is configured to attach to a downspout trough or a gutter trough; and (c) one or more see-through sections are incorporated in at least one of the inner-bend wall, the outer-bend wall, or the side walls, said one or more see-through sections extending from one end of the elbow to an opposite end of the elbow section, and such see-through sections being integrated with the elbow section and being either transparent or translucent.

24. A gutter trough, comprising a gutter-base-wall that is connected on its front facing side to a gutter-front-wall and on its opposite rear facing side to a gutter-rear-wall, said gutter-front-wall and said gutter-base-wall each incorporating an opaque section and a longitudinal see-through section positioned so as to extend from one end of the gutter trough to an opposite end of the gutter trough, wherein the see-through section of the gutter-front-wall is spaced an elevated distance from the gutter-base-wall and is separated therefrom by the gutter-front-wall opaque section, said gutter section being connectable to an elbow section or to a downspout trough.

25. A downspout trough, comprising a downspout-front-wall positioned opposite to a downspout-rear-wall and being connected to each of two downspout-side-walls that are positioned opposite to each other, said downspout-front-wall, downspout-rear-wall and two downspout-side walls forming an elongate trough, and at least one of said downspout-side-walls incorporating a longitudinal see-through section and a longitudinal opaque section, each of the see-through section and opaque section extending from one end of the downspout trough to an opposite end of the downspout trough, said downspout trough being attachable to an elbow section, another downspout trough, or a gutter trough.

* * * * *